US006697084B1

(12) United States Patent
Ohmae et al.

(10) Patent No.: US 6,697,084 B1
(45) Date of Patent: Feb. 24, 2004

(54) TONE DISPLAY METHOD

(75) Inventors: Hideki Ohmae, Sandai (JP); Hisakazu Hitomi, Okayama (JP); Adam J. Kunzman, Fairview, TX (US)

(73) Assignees: Texas Instruments Incorporated, Dallas, TX (US); Matsushita Electric Industrial Co. Ltd., Osaka (JP)

( * ) Notice: Subject to any disclaimer, the term of this patent is extended or adjusted under 35 U.S.C. 154(b) by 0 days.

(21) Appl. No.: 09/517,651

(22) Filed: Mar. 3, 2000

Related U.S. Application Data

(60) Provisional application No. 60/122,845, filed on Mar. 4, 1999.

(51) Int. Cl.[7] ..... G09G 5/10

(52) U.S. Cl. ..... 345/690

(58) Field of Search ..... 345/1.1, 1.3, 3.1, 345/4, 32, 37, 41, 55, 63, 84, 85, 87, 88, 89, 90, 97, 99, 204, 205, 214, 589, 596, 601, 639, 690–693, 697, 134 FOR; 348/743, 750, 760, 771, 790, 791, 797, 800, 803

(56) References Cited

U.S. PATENT DOCUMENTS 5,317,334 A 5/1994 Sano ..... 345/148
5,619,228 A 4/1997 Doherty ..... 345/148
6,052,112 A * 4/2000 Tanaka et al. ..... 345/147

OTHER PUBLICATIONS

Masuda, T., et al., "Pseudo Shadow–Like Noise Observed on Pulse Width Modulated Moving Image Display"—(Japanese Title), "New Category Contour Noise Observed in Pulse–Width–Modulated Moving Images"—(English Title), Television Gakkai Gijutsu Hokoku, vol. 19, No. 2, IDY95–21, pp. 61–66.

Doherty, et al., "10.4: Phased Reset Timing for Improved Digital Micromirror Device (DMD) Brightness," SID 98 Digest, pp. 125–128.

* cited by examiner

*Primary Examiner*—Matthew C. Bella
*Assistant Examiner*—G. F. Cunningham
(74) *Attorney, Agent, or Firm*—Charles A. Brill; Wade James Brady, III; Frederick J. Telecky, Jr.

(57) ABSTRACT

A tone display method which prevents degradation in image quality of moving images when the subfield method is utilized without an increase in cost. When tone display is performed with 256 tones with respect to one certain color, in each frame, segments 1 to 6 in time are set corresponding to the plural time-shared time bands of the color and each segment includes one or several subfields (sf). In each case, as the tone is increased by 42 (or 43) for segments 1 through 6, sequentially, the subfields in the segment being lit so that the tone is increased continuously. In each segment, the display is performed mostly according to the binary method for the subfields

16 Claims, 34 Drawing Sheets

Key: 1 Segment
2 Duration
3 Tone

Key: 1 Segment
2 Duration
3 Tone

Key:
1 Segment
2 Tone
3 See Figure 3
4 All ON
5 All OFF
6 See Figure 4
7 See Figure 5
8 See Figure 6
9 See Figure 7
10 See Figure 8

| 階調 (1) | セグメント1 (2) | | | | | | セグメント2～6 7～36sf (2) | オンの時間長 (3) |
|---|---|---|---|---|---|---|---|---|
| | 1sf | 2sf | 3sf | 4sf | 5sf | 6sf | | |
| 0 | | | | | | | 全てオフ (4) | 0t |
| 1 | | | | | | 1t | | 1t |
| 2 | 2t | | | | | | | 2t |
| 3 | 2t | | | | | 1t | | 3t |
| 4 | | | 4t | | | | | 4t |
| 5 | | | 4t | | | 1t | | 5t |
| 6 | 2t | | 4t | | | | | 6t |
| 7 | 2t | | 4t | | | 1t | | 7t |
| 8 | | | | 8t | | | | 8t |
| 9 | | | | 8t | | 1t | | 9t |
| 10 | 2t | | | 8t | | | | 10t |
| 11 | 2t | | | 8t | | 1t | | 11t |
| 12 | | | 4t | 8t | | | | 12t |
| 13 | | | 4t | 8t | | 1t | | 13t |
| 14 | 2t | | 4t | 8t | | | | 14t |
| 15 | 2t | | 4t | 8t | | 1t | | 15t |
| 16 | | 16t | | | | | | 16t |
| 17 | | 16t | | | | 1t | | 17t |
| 18 | 2t | 16t | | | | | | 18t |
| 19 | 2t | 16t | | | | 1t | | 19t |
| 20 | | 16t | 4t | | | | | 20t |
| 21 | | 16t | 4t | | | 1t | | 21t |
| 22 | 2t | 16t | 4t | | | | | 22t |
| 23 | 2t | 16t | 4t | | | 1t | | 23t |
| 24 | | 16t | | 8t | | | | 24t |
| 25 | | 16t | | 8t | | 1t | | 25t |
| 26 | 2t | 16t | | 8t | | | | 26t |
| 27 | 2t | 16t | | 8t | | 1t | | 27t |
| 28 | | 16t | 4t | 8t | | | | 28t |
| 29 | | 16t | 4t | 8t | | 1t | | 29t |
| 30 | 2t | 16t | 4t | 8t | | | | 30t |
| 31 | 2t | 16t | 4t | 8t | | 1t | | 31t |
| 32 | | 16t | 4t | | 11t | 1t | | 32t |
| 33 | 2t | 16t | 4t | | 11t | | | 33t |
| 34 | 2t | 16t | 4t | | 11t | 1t | | 34t |
| 35 | | 16t | | 8t | 11t | | | 35t |
| 36 | | 16t | | 8t | 11t | 1t | | 36t |
| 37 | 2t | 16t | | 8t | 11t | | | 37t |
| 38 | 2t | 16t | | 8t | 11t | 1t | | 38t |
| 39 | | 16t | 4t | 8t | 11t | | | 39t |
| 40 | | 16t | 4t | 8t | 11t | 1t | | 40t |
| 41 | 2t | 16t | 4t | 8t | 11t | | | 41t |
| 42 | 2t | 16t | 4t | 8t | 11t | 1t | | 42t |

Figure 3

Key: 1 Tone
2 Segment
3 Duration of ON
4 All OFF

| 階調 (1) | セグメント1 (2) | セグメント2 (3) | | | | | | セグメント3〜6 | オンの時間長 (3) |
|---|---|---|---|---|---|---|---|---|---|
| | 1〜6sf | 7sf | 8sf | 9sf | 10sf | 11sf | 12sf | 13〜36sf (2) | |
| 43 | | | | | | | 1t | | 43t |
| 44 | | 2t | | | | | | | 44t |
| 45 | | 2t | | | | | 1t | | 45t |
| 46 | | | | 4t | | | | | 46t |
| 47 | | | | 4t | | | 1t | | 47t |
| 48 | | 2t | | 4t | | | | | 48t |
| 49 | | 2t | | 4t | | | 1t | | 49t |
| 50 | | | | | 8t | | | | 50t |
| 51 | | | | | 8t | | 1t | | 51t |
| 52 | | 2t | | | 8t | | | | 52t |
| 53 | | 2t | | | 8t | | 1t | | 53t |
| 54 | | | | 4t | 8t | | | | 54t |
| 55 | | | | 4t | 8t | | 1t | | 55t |
| 56 | | 2t | | 4t | 8t | | | | 56t |
| 57 | | 2t | | 4t | 8t | | 1t | | 57t |
| 58 | | | 16t | | | | | | 58t |
| 59 | | | 16t | | | | 1t | | 59t |
| 60 | 全てオン (4) | 2t | 16t | | | | | 全てオフ (5) | 60t |
| 61 | | 2t | 16t | | | | 1t | | 61t |
| 62 | | | 16t | 4t | | | | | 62t |
| 63 | | | 16t | 4t | | | 1t | | 63t |
| 64 | | 2t | 16t | 4t | | | | | 64t |
| 65 | | 2t | 16t | 4t | | | 1t | | 65t |
| 66 | | | 16t | | 8t | | | | 66t |
| 67 | | | 16t | | 8t | | 1t | | 67t |
| 68 | | 2t | 16t | | 8t | | | | 68t |
| 69 | | 2t | 16t | | 8t | | 1t | | 69t |
| 70 | | | 16t | 4t | 8t | | | | 70t |
| 71 | | | 16t | 4t | 8t | | 1t | | 71t |
| 72 | | 2t | 16t | 4t | 8t | | | | 72t |
| 73 | | 2t | 16t | 4t | 8t | | 1t | | 73t |
| 74 | | | 16t | 4t | | 12t | | | 74t |
| 75 | | | 16t | 4t | | 12t | 1t | | 75t |
| 76 | | 2t | 16t | 4t | | 12t | | | 76t |
| 77 | | 2t | 16t | 4t | | 12t | 1t | | 77t |
| 78 | | | 16t | | 8t | 12t | | | 78t |
| 79 | | | 16t | | 8t | 12t | 1t | | 79t |
| 80 | | 2t | 16t | | 8t | 12t | | | 80t |
| 81 | | 2t | 16t | | 8t | 12t | 1t | | 81t |
| 82 | | | 16t | 4t | 8t | 12t | | | 82t |
| 83 | | | 16t | 4t | 8t | 12t | 1t | | 83t |
| 84 | | 2t | 16t | 4t | 8t | 12t | | | 84t |
| 85 | | 2t | 16t | 4t | 8t | 12t | 1t | | 85t |

Figure 4

Key: 1 Tone
2 Segment
3 Duration of ON
4 All ON
5 All OFF

| 階調 (1) | セグメント1～2 (2) 1～12sf | セグメント3 (2) 13sf | 14sf | 15sf | 16sf | 17sf | 18sf | セグメント4～6 (2) 19～36sf | オンの時間長 (3) |
|---|---|---|---|---|---|---|---|---|---|
| 86 | 全てオン (4) | | | | | | 1t | 全てオフ (5) | 86t |
| 87 | | 2t | | | | | | | 87t |
| 88 | | 2t | | | | | 1t | | 88t |
| 89 | | | | 4t | | | | | 89t |
| 90 | | | | 4t | | | 1t | | 90t |
| 91 | | 2t | | 4t | | | | | 91t |
| 92 | | 2t | | 4t | | | 1t | | 92t |
| 93 | | | | | 8t | | | | 93t |
| 94 | | | | | 8t | | 1t | | 94t |
| 95 | | 2t | | | 8t | | | | 95t |
| 96 | | 2t | | | 8t | | 1t | | 96t |
| 97 | | | | 4t | 8t | | | | 97t |
| 98 | | | | 4t | 8t | | 1t | | 98t |
| 99 | | 2t | | 4t | 8t | | | | 99t |
| 100 | | 2t | | 4t | 8t | | 1t | | 100t |
| 101 | | | 16t | | | | | | 101t |
| 102 | | | 16t | | | | 1t | | 102t |
| 103 | | 2t | 16t | | | | | | 103t |
| 104 | | 2t | 16t | | | | 1t | | 104t |
| 105 | | | 16t | 4t | | | | | 105t |
| 106 | | | 16t | 4t | | | 1t | | 106t |
| 107 | | 2t | 16t | 4t | | | | | 107t |
| 108 | | 2t | 16t | 4t | | | 1t | | 108t |
| 109 | | | 16t | | 8t | | | | 109t |
| 110 | | | 16t | | 8t | | 1t | | 110t |
| 111 | | 2t | 16t | | 8t | | | | 111t |
| 112 | | 2t | 16t | | 8t | | 1t | | 112t |
| 113 | | | 16t | 4t | 8t | | | | 113t |
| 114 | | | 16t | 4t | 8t | | 1t | | 114t |
| 115 | | 2t | 16t | 4t | 8t | | | | 115t |
| 116 | | 2t | 16t | 4t | 8t | | 1t | | 116t |
| 117 | | | 16t | 4t | | 11t | 1t | | 117t |
| 118 | | 2t | 16t | 4t | | 11t | | | 118t |
| 119 | | 2t | 16t | 4t | | 11t | 1t | | 119t |
| 120 | | | 16t | | 8t | 11t | | | 120t |
| 121 | | | 16t | | 8t | 11t | 1t | | 121t |
| 122 | | 2t | 16t | | 8t | 11t | | | 122t |
| 123 | | 2t | 16t | | 8t | 11t | 1t | | 123t |
| 124 | | | 16t | 4t | 8t | 11t | | | 124t |
| 125 | | | 16t | 4t | 8t | 11t | 1t | | 125t |
| 126 | | 2t | 16t | 4t | 8t | 11t | | | 126t |
| 127 | | 2t | 16t | 4t | 8t | 11t | 1t | | 127t |

Figure 5

Key: 1 Tone
2 Segment
3 Duration of ON
4 All ON
5 All OFF

| 階調 (1) | セグメント1～3 1～18sf (2) | セグメント4 (3) 19sf | 20sf | 21sf | 22sf | 23sf | 24sf | セグメント5～6 25～36sf (2) | オンの時間長 (3) |
|---|---|---|---|---|---|---|---|---|---|
| 128 | | | | | | | 1t | | 128t |
| 129 | | 2t | | | | | | | 129t |
| 130 | | 2t | | | | | 1t | | 130t |
| 131 | | | | 4t | | | | | 131t |
| 132 | | | | 4t | | | 1t | | 132t |
| 133 | | 2t | | 4t | | | | | 133t |
| 134 | | 2t | | 4t | | | 1t | | 134t |
| 135 | | | | | 8t | | | | 135t |
| 136 | | | | | 8t | | 1t | | 136t |
| 137 | | 2t | | | 8t | | | | 137t |
| 138 | | 2t | | | 8t | | 1t | | 138t |
| 139 | | | | 4t | 8t | | | | 139t |
| 140 | | | | 4t | 8t | | 1t | | 140t |
| 141 | | 2t | | 4t | 8t | | | | 141t |
| 142 | | 2t | | 4t | 8t | | 1t | | 142t |
| 143 | | | 16t | | | | | | 143t |
| 144 | | | 16t | | | | 1t | | 144t |
| 145 | 全てオン (4) | 2t | 16t | | | | | 全てオフ (5) | 145t |
| 146 | | 2t | 16t | | | | 1t | | 146t |
| 147 | | | 16t | 4t | | | | | 147t |
| 148 | | | 16t | 4t | | | 1t | | 148t |
| 149 | | 2t | 16t | 4t | | | | | 149t |
| 150 | | 2t | 16t | 4t | | | 1t | | 150t |
| 151 | | | 16t | | 8t | | | | 151t |
| 152 | | | 16t | | 8t | | 1t | | 152t |
| 153 | | 2t | 16t | | 8t | | | | 153t |
| 154 | | 2t | 16t | | 8t | | 1t | | 154t |
| 155 | | | 16t | 4t | 8t | | | | 155t |
| 156 | | | 16t | 4t | 8t | | 1t | | 156t |
| 157 | | 2t | 16t | 4t | 8t | | | | 157t |
| 158 | | 2t | 16t | 4t | 8t | | 1t | | 158t |
| 159 | | | 16t | 4t | | 12t | | | 159t |
| 160 | | | 16t | 4t | | 12t | 1t | | 160t |
| 161 | | 2t | 16t | 4t | | 12t | | | 161t |
| 162 | | 2t | 16t | 4t | | 12t | 1t | | 162t |
| 163 | | | 16t | | 8t | 12t | | | 163t |
| 164 | | | 16t | | 8t | 12t | 1t | | 164t |
| 165 | | 2t | 16t | | 8t | 12t | | | 165t |
| 166 | | 2t | 16t | | 8t | 12t | 1t | | 166t |
| 167 | | | 16t | 4t | 8t | 12t | | | 167t |
| 168 | | | 16t | 4t | 8t | 12t | 1t | | 168t |
| 169 | | 2t | 16t | 4t | 8t | 12t | | | 169t |
| 170 | | 2t | 16t | 4t | 8t | 12t | 1t | | 170t |

Figure 6

Key: 1 Tone
2 Segment
3 Duration of ON
4 All ON
5 All OFF

| 階調 (1) | セグメント1～4 1～24st | セグメント5 (2) 25st | 26st | 27st | 28st | 29st | 30st | セグメント6 31～36st | オンの時間長 (3) |
|---|---|---|---|---|---|---|---|---|---|
| 171 | (3) | | | | | | 1t | (3) | 171t |
| 172 | | 2t | | | | | | | 172t |
| 173 | | 2t | | | | | 1t | | 173t |
| 174 | | | | 4t | | | | | 174t |
| 175 | | | | 4t | | | 1t | | 175t |
| 176 | | 2t | | 4t | | | | | 176t |
| 177 | | 2t | | 4t | | | 1t | | 177t |
| 178 | | | | | 8t | | | | 178t |
| 179 | | | | | 8t | | 1t | | 179t |
| 180 | | 2t | | | 8t | | | | 180t |
| 181 | | 2t | | | 8t | | 1t | | 181t |
| 182 | | | | 4t | 8t | | | | 182t |
| 183 | | | | 4t | 8t | | 1t | | 183t |
| 184 | | 2t | | 4t | 8t | | | | 184t |
| 185 | | 2t | | 4t | 8t | | 1t | | 185t |
| 186 | | | 16t | | | | | | 186t |
| 187 | 全てオン (4) | | 16t | | | | 1t | 全てオフ (5) | 187t |
| 188 | | 2t | 16t | | | | | | 188t |
| 189 | | 2t | 16t | | | | 1t | | 189t |
| 190 | | | 16t | 4t | | | | | 190t |
| 191 | | | 16t | 4t | | | 1t | | 191t |
| 192 | | 2t | 16t | 4t | | | | | 192t |
| 193 | | 2t | 16t | 4t | | | 1t | | 193t |
| 194 | | | 16t | | 8t | | | | 194t |
| 195 | | | 16t | | 8t | | 1t | | 195t |
| 196 | | 2t | 16t | | 8t | | | | 196t |
| 197 | | 2t | 16t | | 8t | | 1t | | 197t |
| 198 | | | 16t | 4t | 8t | | | | 198t |
| 199 | | | 16t | 4t | 8t | | 1t | | 199t |
| 200 | | 2t | 16t | 4t | 8t | | | | 200t |
| 201 | | 2t | 16t | 4t | 8t | | 1t | | 201t |
| 202 | | | 16t | 4t | | 11t | 1t | | 202t |
| 203 | | 2t | 16t | 4t | | 11t | | | 203t |
| 204 | | 2t | 16t | 4t | | 11t | 1t | | 204t |
| 205 | | | 16t | | 8t | 11t | | | 205t |
| 206 | | | 16t | | 8t | 11t | 1t | | 206t |
| 207 | | 2t | 16t | | 8t | 11t | | | 207t |
| 208 | | 2t | 16t | | 8t | 11t | 1t | | 208t |
| 209 | | | 16t | 4t | 8t | 11t | | | 209t |
| 210 | | | 16t | 4t | 8t | 11t | 1t | | 210t |
| 211 | | 2t | 16t | 4t | 8t | 11t | | | 211t |
| 212 | | 2t | 16t | 4t | 8t | 11t | 1t | | 212t |

Figure 7

Key: 1 Tone
2 Segment
3 Duration of ON
4 All ON
5 All OFF

| 階調 1 | セグメント1～5 2 | セグメント6 3 | | | | | | オンの時間長 3 |
|---|---|---|---|---|---|---|---|---|
| | 1～31sf | 31sf | 32sf | 33sf | 34sf | 35sf | 36sf | |
| 213 | | | | | | | 1t | 213t |
| 214 | | 2t | | | | | | 214t |
| 215 | | 2t | | | | | 1t | 215t |
| 216 | | | | 4t | | | | 216t |
| 217 | | | | 4t | | | 1t | 217t |
| 218 | | 2t | | 4t | | | | 218t |
| 219 | | 2t | | 4t | | | 1t | 219t |
| 220 | | | | | 8t | | | 220t |
| 221 | | | | | 8t | | 1t | 221t |
| 222 | | 2t | | | 8t | | | 222t |
| 223 | | 2t | | | 8t | | 1t | 223t |
| 224 | | | | 4t | 8t | | | 224t |
| 225 | | | | 4t | 8t | | 1t | 225t |
| 226 | | 2t | | 4t | 8t | | | 226t |
| 227 | | 2t | | 4t | 8t | | 1t | 227t |
| 228 | 4 全てオン | | 16t | | | | | 228t |
| 229 | | | 16t | | | | 1t | 229t |
| 230 | | 2t | 16t | | | | | 230t |
| 231 | | 2t | 16t | | | | 1t | 231t |
| 232 | | | 16t | 4t | | | | 232t |
| 233 | | | 16t | 4t | | | 1t | 233t |
| 234 | | 2t | 16t | 4t | | | | 234t |
| 235 | | 2t | 16t | 4t | | | 1t | 235t |
| 236 | | | 16t | | 8t | | | 236t |
| 237 | | | 16t | | 8t | | 1t | 237t |
| 238 | | 2t | 16t | | 8t | | | 238t |
| 239 | | 2t | 16t | | 8t | | 1t | 239t |
| 240 | | | 16t | 4t | 8t | | | 240t |
| 241 | | | 16t | 4t | 8t | | 1t | 241t |
| 242 | | 2t | 16t | 4t | 8t | | | 242t |
| 243 | | 2t | 16t | 4t | 8t | | 1t | 243t |
| 244 | | | 16t | 4t | | 12t | | 244t |
| 245 | | | 16t | 4t | | 12t | 1t | 245t |
| 246 | | 2t | 16t | 4t | | 12t | | 246t |
| 247 | | 2t | 16t | 4t | | 12t | 1t | 247t |
| 248 | | | 16t | | 8t | 12t | | 248t |
| 249 | | | 16t | | 8t | 12t | 1t | 249t |
| 250 | | 2t | 16t | | 8t | 12t | | 250t |
| 251 | | 2t | 16t | | 8t | 12t | 1t | 251t |
| 252 | | | 16t | 4t | 8t | 12t | | 252t |
| 253 | | | 16t | 4t | 8t | 12t | 1t | 253t |
| 254 | | 2t | 16t | 4t | 8t | 12t | | 254t |
| 255 | | 2t | 16t | 4t | 8t | 12t | 1t | 255t |

Figure 8

Key: 1 Tone
2 Segment
3 Duration of ON
4 All ON

Key: 1 Segment
2 Duration
3 Tone

| 階調(1) | (2)セグメント1 1～5sf | (2)セグメント2 6～11sf | (2)セグメント3 12～16sf | (2)セグメント4 17～22sf | (2)セグメント5 23～27sf | (2)セグメント6 28～33sf |
|---|---|---|---|---|---|---|
| 0～31 | (5)図12参照 | 全てオフ | 全てオフ | 全てオフ | 全てオフ | 全てオフ |
| 32～85 | 全てオン | (6)図13参照 | 全てオフ | 全てオフ | 全てオフ | 全てオフ (4) |
| 86～116 | 全てオン | 全てオン | (5)図12参照 | 全てオフ | 全てオフ | 全てオフ |
| 117～170 | 全てオン | 全てオン | 全てオン | (6)図13参照 | 全てオフ | 全てオフ |
| 171～201 | 全てオン | 全てオン | 全てオン | 全てオン | (5)図12参照 | 全てオフ |
| 202～255 | 全てオン | 全てオン (3) | 全てオン | 全てオン | 全てオン | (6)図13参照 |

Figure 11

Key: 1 Tone
2 Segment
3 All ON
4 All OFF
5 See Figure 12
6 See Figure 13

| 1 階調 | 2 セグメント1 | | | | |
|---|---|---|---|---|---|
| | 1sf | 2sf | 3sf | 4sf | 5sf |
| 1 | | | | | 1t |
| 2 | 2t | | | | |
| 3 | 2t | | | | 1t |
| 4 | | | 4t | | |
| 5 | | | 4t | | 1t |
| 6 | 2t | | 4t | | |
| 7 | 2t | | 4t | | 1t |
| 8 | | | | 8t | |
| 9 | | | | 8t | 1t |
| 10 | 2t | | | 8t | |
| 11 | 2t | | | 8t | 1t |
| 12 | | | 4t | 8t | |
| 13 | | | 4t | 8t | 1t |
| 14 | 2t | | 4t | 8t | |
| 15 | 2t | | 4t | 8t | 1t |
| 16 | | 16t | | | |
| 17 | | 16t | | | 1t |
| 18 | 2t | 16t | | | |
| 19 | 2t | 16t | | | 1t |
| 20 | | 16t | 4t | | |
| 21 | | 16t | 4t | | 1t |
| 22 | 2t | 16t | 4t | | |
| 23 | 2t | 16t | 4t | | 1t |
| 24 | | 16t | | 8t | |
| 25 | | 16t | | 8t | 1t |
| 26 | 2t | 16t | | 8t | |
| 27 | 2t | 16t | | 8t | 1t |
| 28 | | 16t | 4t | 8t | |
| 29 | | 16t | 4t | 8t | 1t |
| 30 | 2t | 16t | 4t | 8t | |
| 31 | 2t | 16t | 4t | 8t | 1t |

Figure 12

Key: 1 Tone
2 Segment

| 1 階調 | 2 セグメント2 | | | | | |
|---|---|---|---|---|---|---|
| | 6sf | 7sf | 8sf | 9sf | 10sf | 11sf |
| 32 | | | | | | 1t |
| 33 | 2t | | | | | |
| 34 | 2t | | | | | 1t |
| 35 | | | 4t | | | |
| 36 | | | 4t | | | 1t |
| 37 | 2t | | 4t | | | |
| 38 | 2t | | 4t | | | 1t |
| 39 | | | | 8t | | |
| 40 | | | | 8t | | 1t |
| 41 | 2t | | | 8t | | |
| 42 | 2t | | | 8t | | 1t |
| 43 | | | 4t | 8t | | |
| 44 | | | 4t | 8t | | 1t |
| 45 | 2t | | 4t | 8t | | |
| 46 | 2t | | 4t | 8t | | 1t |
| 47 | | 16t | | | | |
| 48 | | 16t | | | | 1t |
| 49 | 2t | 16t | | | | |
| 50 | 2t | 16t | | | | 1t |
| 51 | | 16t | 4t | | | |
| 52 | | 16t | 4t | | | 1t |
| 53 | 2t | 16t | 4t | | | |
| 54 | 2t | 16t | 4t | | | 1t |
| 55 | | 16t | | 8t | | |
| 56 | | 16t | | 8t | | 1t |
| 57 | 2t | 16t | | 8t | | |
| 58 | 2t | 16t | | 8t | | 1t |
| 59 | | 16t | 4t | 8t | | |
| 60 | | 16t | 4t | 8t | | 1t |
| 61 | 2t | 16t | 4t | 8t | | |
| 62 | 2t | 16t | 4t | 8t | | 1t |
| 63 | | | | 8t | 23t | 1t |
| 64 | 2t | | | 8t | 23t | |
| 65 | 2t | | | 8t | 23t | 1t |
| 66 | | | 4t | 8t | 23t | |
| 67 | | | 4t | 8t | 23t | 1t |
| 68 | 2t | | 4t | 8t | 23t | |
| 69 | 2t | | 4t | 8t | 23t | 1t |
| 70 | | 16t | | | 23t | |
| 71 | | 16t | | | 23t | 1t |
| 72 | 2t | 16t | | | 23t | |
| 73 | 2t | 16t | | | 23t | 1t |
| 74 | | 16t | 4t | | 23t | |
| 75 | | 16t | 4t | | 23t | 1t |
| 76 | 2t | 16t | 4t | | 23t | |
| 77 | 2t | 16t | 4t | | 23t | 1t |
| 78 | | 16t | | 8t | 23t | |
| 79 | | 16t | | 8t | 23t | 1t |
| 80 | 2t | 16t | | 8t | 23t | |
| 81 | 2t | 16t | | 8t | 23t | 1t |
| 82 | | 16t | 4t | 8t | 23t | |
| 83 | | 16t | 4t | 8t | 23t | 1t |
| 84 | 2t | 16t | 4t | 8t | 23t | |
| 85 | 2t | 16t | 4t | 8t | 23t | 1t |

Figure 13

Key: 1 Tone
2 Segment

Key: 1 Segment
2 Duration
3 Tone

| 階調 (1) | (2)セグメント1 1~6sf | (2)セグメント2 7~12sf | (2)セグメント3 13~18sf | (2)セグメント4 19~24sf | (2)セグメント5 25~30sf | (2)セグメント6 31~36sf | (2)セグメント7 37~42sf | (2)セグメント8 43~47sf |
|---|---|---|---|---|---|---|---|---|
| 0~32 | (5)図16参照 | 全てオフ | 全てオフ | 全てオフ | 全てオフ | 全てオフ | 全てオフ | 全てオフ |
| 33~64 | 全てオン | (5)図16参照 | 全てオフ | 全てオフ | 全てオフ | 全てオフ | 全てオフ | 全てオフ |
| 65~96 | 全てオン | 全てオン | (5)図16参照 | 全てオフ | 全てオフ | 全てオフ | 全てオフ | 全てオフ (4) |
| 97~128 | 全てオン | 全てオン | 全てオン | (5)図16参照 | 全てオフ | 全てオフ | 全てオフ | 全てオフ |
| 129~160 | 全てオン | 全てオン | 全てオン | 全てオン | (5)図16参照 | 全てオフ | 全てオフ | 全てオフ |
| 161~192 | 全てオン | 全てオン | 全てオン | 全てオン | 全てオン | (5)図16参照 | 全てオフ | 全てオフ |
| 193~224 | 全てオン | 全てオン | 全てオン | 全てオン | 全てオン | 全てオン | (5)図16参照 | 全てオフ |
| 225~255 | 全てオン | 全てオン (5) | 全てオン | 全てオン | 全てオン | 全てオン | 全てオン | (6)図17参照 |

Figure 15

Key: 1 Tone
2 Segment
3 All ON
4 All OFF
5 See Figure 16
6 See Figure 17

| 1 階調 | セグメント1 2 | | | | | |
|---|---|---|---|---|---|---|
| | 1sf | 2sf | 3sf | 4sf | 5sf | 6sf |
| 1 | | | | | | 1t |
| 2 | 2t | | | | | |
| 3 | 2t | | | | | 1t |
| 4 | | | | 4t | | |
| 5 | | | | 4t | | 1t |
| 6 | 2t | | | 4t | | |
| 7 | 2t | | | 4t | | 1t |
| 8 | | | | | 8t | |
| 9 | | | | | 8t | 1t |
| 10 | 2t | | | | 8t | |
| 11 | 2t | | | | 8t | 1t |
| 12 | | | | 4t | 8t | |
| 13 | | | | 4t | 8t | 1t |
| 14 | 2t | | | 4t | 8t | |
| 15 | 2t | | | 4t | 8t | 1t |
| 16 | | 16t | | | | |
| 17 | | 16t | | | | 1t |
| 18 | 2t | 16t | | | | |
| 19 | 2t | 16t | | | | 1t |
| 20 | | 16t | | 4t | | |
| 21 | | 16t | | 4t | | 1t |
| 22 | 2t | 16t | | 4t | | |
| 23 | 2t | 16t | | 4t | | 1t |
| 24 | | 16t | | | 8t | |
| 25 | | 16t | | | 8t | 1t |
| 26 | 2t | 16t | | | 8t | |
| 27 | 2t | 16t | | | 8t | 1t |
| 28 | | 16t | | 4t | 8t | |
| 29 | | 16t | | 4t | 8t | 1t |
| 30 | 2t | 16t | | 4t | 8t | |
| 31 | 2t | 16t | | 4t | 8t | 1t |
| 32 | 2t | 16t | 1t | 4t | 8t | 1t |

Figure 16

Key: 1 Tone
2 Segment

| 階調 1 | セグメント8 2 | | | | |
|---|---|---|---|---|---|
| | 43sf | 44sf | 45sf | 46sf | 47sf |
| 225 | | | | | 1t |
| 226 | 2t | | | | |
| 227 | 2t | | | | 1t |
| 228 | | | 4t | | |
| 229 | | | 4t | | 1t |
| 230 | 2t | | 4t | | |
| 231 | 2t | | 4t | | 1t |
| 232 | | | | 8t | |
| 233 | | | | 8t | 1t |
| 234 | 2t | | | 8t | |
| 235 | 2t | | | 8t | 1t |
| 236 | | | 4t | 8t | |
| 237 | | | 4t | 8t | 1t |
| 238 | 2t | | 4t | 8t | |
| 239 | 2t | | 4t | 8t | 1t |
| 240 | | 16t | | | |
| 241 | | 16t | | | 1t |
| 242 | 2t | 16t | | | |
| 243 | 2t | 16t | | | 1t |
| 244 | | 16t | 4t | | |
| 245 | | 16t | 4t | | 1t |
| 246 | 2t | 16t | 4t | | |
| 247 | 2t | 16t | 4t | | 1t |
| 248 | | 16t | | 8t | |
| 249 | | 16t | | 8t | 1t |
| 250 | 2t | 16t | | 8t | |
| 251 | 2t | 16t | | 8t | 1t |
| 252 | | 16t | 4t | 8t | |
| 253 | | 16t | 4t | 8t | 1t |
| 254 | 2t | 16t | 4t | 8t | |
| 255 | 2t | 16t | 4t | 8t | 1t |

Figure 17

Key: 1 Tone
2 Segment

Key: 1 Segment
2 Duration
3 Tone

| ① 階調 | ② セグメント1 1～7sf | ② セグメント2 8～14sf | ② セグメント3 15～21sf | ② セグメント4 22～27sf |
|---|---|---|---|---|
| 0～64 | ⑤ 図20参照 | 全てオフ | 全てオフ | 全てオフ |
| 65～128 | 全てオン | ⑤ 図20参照 | 全てオフ | 全てオフ ④ |
| 129～192 | 全てオン | 全てオン | ⑤ 図20参照 | 全てオフ |
| 192～255 | 全てオン | 全てオン | 全てオン | ⑥ 図21参照 |

③

Figure 19

Key:
1 Tone
2 Segment
3 All ON
4 All OFF
5 See Figure 20
6 See Figure 21

| 音 (1) | セグメント (2) | | | | | | |
|---|---|---|---|---|---|---|---|
| | 1sf | 2sf | 3sf | 4sf | 5sf | 6sf | 7sf |
| 1 | | | | | | | 1t |
| 2 | 2t | | | | | | |
| 3 | 2t | | | | | | 1t |
| 4 | | | | | 4t | | |
| 5 | | | | | 4t | | 1t |
| 6 | 2t | | | | 4t | | |
| 7 | 2t | | | | 4t | | 1t |
| 8 | | | | | | 8t | |
| 9 | | | | | | 8t | 1t |
| 10 | 2t | | | | | 8t | |
| 11 | 2t | | | | | 8t | 1t |
| 12 | | | | | 4t | 8t | |
| 13 | | | | | 4t | 8t | 1t |
| 14 | 2t | | | | 4t | 8t | |
| 15 | 2t | | | | 4t | 8t | 1t |
| 16 | | 16t | | | | | |
| 17 | | 16t | | | | | 1t |
| 18 | 2t | 16t | | | | | |
| 19 | 2t | 16t | | | | | 1t |
| 20 | | 16t | | | 4t | | |
| 21 | | 16t | | | 4t | | 1t |
| 22 | 2t | 16t | | | 4t | | |
| 23 | 2t | 16t | | | 4t | | 1t |
| 24 | | 16t | | | | 8t | |
| 25 | | 16t | | | | 8t | 1t |
| 26 | 2t | 16t | | | | 8t | |
| 27 | 2t | 16t | | | | 8t | 1t |
| 28 | | 16t | | | 4t | 8t | |
| 29 | | 16t | | | 4t | 8t | 1t |
| 30 | 2t | 16t | | | 4t | 8t | |
| 31 | 2t | 16t | | | 4t | 8t | 1t |
| 32 | | | | 32t | | | |
| 33 | | | | 32t | | | 1t |
| 34 | 2t | | | 32t | | | |
| 35 | 2t | | | 32t | | | 1t |
| 36 | | | | 32t | 4t | | |
| 37 | | | | 32t | 4t | | 1t |
| 38 | 2t | | | 32t | 4t | | |
| 39 | 2t | | | 32t | 4t | | 1t |
| 40 | | | | 32t | | 8t | |
| 41 | | | | 32t | | 8t | 1t |
| 42 | 2t | | | 32t | | 8t | |
| 43 | 2t | | | 32t | | 8t | 1t |
| 44 | | | | 32t | 4t | 8t | |
| 45 | | | | 32t | 4t | 8t | 1t |
| 46 | 2t | | | 32t | 4t | 8t | |
| 47 | 2t | | | 32t | 4t | 8t | 1t |
| 48 | | 16t | | 32t | | | |
| 49 | | 16t | | 32t | | | 1t |
| 50 | 2t | 16t | | 32t | | | |
| 51 | 2t | 16t | | 32t | | | 1t |
| 52 | | 16t | | 32t | 4t | | |
| 53 | | 16t | | 32t | 4t | | 1t |
| 54 | 2t | 16t | | 32t | 4t | | |
| 55 | 2t | 16t | | 32t | 4t | | 1t |
| 56 | | 16t | | 32t | | 8t | |
| 57 | | 16t | | 32t | | 8t | 1t |
| 58 | 2t | 16t | | 32t | | 8t | |
| 59 | 2t | 16t | | 32t | | 8t | 1t |
| 60 | | 16t | | 32t | 4t | 8t | |
| 61 | | 16t | | 32t | 4t | 8t | 1t |
| 62 | 2t | 16t | | 32t | 4t | 8t | |
| 63 | 2t | 16t | | 32t | 4t | 8t | 1t |
| 64 | 2t | 16t | 1t | 32t | 4t | 8t | 1t |

Figure 20

Key: 1 Tone
2 Segment

| 音 (1) | セグメント4 (2) | | | | | |
|---|---|---|---|---|---|---|
| | 22sf | 23sf | 24sf | 25sf | | 27sf |
| 193 | | | | | | 1t |
| 194 | 2t | | | | | |
| 195 | 2t | | | | | 1t |
| 196 | | | | 4t | | |
| 197 | | | | 4t | | 1t |
| 198 | 2t | | | 4t | | |
| 199 | 2t | | | 4t | | 1t |
| 200 | | | | | 8t | |
| 201 | | | | | 8t | 1t |
| 202 | 2t | | | | 8t | |
| 203 | 2t | | | | 8t | 1t |
| 204 | | | | 4t | 8t | |
| 205 | | | | 4t | 8t | 1t |
| 206 | 2t | | | 4t | 8t | |
| 207 | 2t | | | 4t | 8t | 1t |
| 208 | | 16t | | | | |
| 209 | | 16t | | | | 1t |
| 210 | 2t | 16t | | | | |
| 211 | 2t | 16t | | | | 1t |
| 212 | | 16t | | 4t | | |
| 213 | | 16t | | 4t | | 1t |
| 214 | 2t | 16t | | 4t | | |
| 215 | 2t | 16t | | 4t | | 1t |
| 216 | | 16t | | | 8t | |
| 217 | | 16t | | | 8t | 1t |
| 218 | 2t | 16t | | | 8t | |
| 219 | 2t | 16t | | | 8t | 1t |
| 220 | | 16t | | 4t | 8t | |
| 221 | | 16t | | 4t | 8t | 1t |
| 222 | 2t | 16t | | 4t | 8t | |
| 223 | 2t | 16t | | 4t | 8t | 1t |
| 224 | | | 32t | | | |
| 225 | | | 32t | | | 1t |
| 226 | 2t | | 32t | | | |
| 227 | 2t | | 32t | | | 1t |
| 228 | | | 32t | 4t | | |
| 229 | | | 32t | 4t | | 1t |
| 230 | 2t | | 32t | 4t | | |
| 231 | 2t | | 32t | 4t | | 1t |
| 232 | | | 32t | | 8t | |
| 233 | | | 32t | | 8t | 1t |
| 234 | 2t | | 32t | | 8t | |
| 235 | 2t | | 32t | | 8t | 1t |
| 236 | | | 32t | 4t | 8t | |
| 237 | | | 32t | 4t | 8t | 1t |
| 238 | 2t | | 32t | 4t | 8t | |
| 239 | 2t | | 32t | 4t | 8t | 1t |
| 240 | | 16t | 32t | | | |
| 241 | | 16t | 32t | | | 1t |
| 242 | 2t | 16t | 32t | | | |
| 243 | 2t | 16t | 32t | | | 1t |
| 244 | | 16t | 32t | 4t | | |
| 245 | | 16t | 32t | 4t | | 1t |
| 246 | 2t | 16t | 32t | 4t | | |
| 247 | 2t | 16t | 32t | 4t | | 1t |
| 248 | | 16t | 32t | | 8t | |
| 249 | | 16t | 32t | | 8t | 1t |
| 250 | 2t | 16t | 32t | | 8t | |
| 251 | 2t | 16t | 32t | | 8t | 1t |
| 252 | | 16t | 32t | 4t | 8t | |
| 253 | | 16t | 32t | 4t | 8t | 1t |
| 254 | 2t | 16t | 32t | 4t | 8t | |
| 255 | 2t | 16t | 32t | 4t | 8t | 1t |

Figure 21

Key: 1 Tone
2 Segment

| 階調① | セグメント1② | セグメント2② | セグメント3② | セグメント4② | セグメント5② | セグメント6② |
|---|---|---|---|---|---|---|
| 0～42 | 全てオフ | 全てオフ | 全てオフ | 全てオフ | 全てオフ | ⑥図4参照 |
| 43～85③ | 全てオフ | 全てオフ | 全てオフ | 全てオフ | ⑤図3参照 | 全てオン |
| 86～127 | 全てオフ | 全てオフ | 全てオフ | ⑥図4参照 | 全てオン | 全てオン |
| 128～170 | 全てオフ | 全てオフ | ⑤図3参照 | 全てオン | 全てオン | 全てオン |
| 171～212 | 全てオフ | ④図4参照 | 全てオン | 全てオン | 全てオン | 全てオン |
| 213～255 | 図3参照⑤ | 全てオン | 全てオン | 全てオン | 全てオン④ | 全てオン |

Figure 22

Key: 1 Tone
2 Segment
3 All OFF
4 All ON
5 See Figure 3
6 See Figure 4

| 1 階調 | 2 セグメント1 | 2 セグメント2 | 2 セグメント3 | 2 セグメント4 | 2 セグメント5 | 2 セグメント6 |
|---|---|---|---|---|---|---|
| 0～42 | 5 図3参照 | 全てオフ | 全てオフ | 全てオフ | 全てオフ | 全てオフ 4 |
| 43～85 | 全てオン | 全てオフ | 6 図3参照 | 全てオフ | 全てオフ | 全てオフ |
| 86～127 | 全てオン | 6 図4参照 | 全てオン | 全てオフ | 全てオフ | 全てオフ |
| 128～170 | 全てオン | 全てオフ | 全てオン | 全てオフ | 5 図3参照 | 全てオン |
| 171～212 | 全てオン | 全てオン | 全てオン | 6 図4参照 | 全てオン | 全てオフ 4 |
| 213～255 | 全てオン 3 | 全てオン | 全てオン | 全てオン 3 | 全てオン | 6 図4参照 |

Figure 23

Key: 1 Tone
2 Segment
3 All ON
4 All OFF
5 See Figure 3
6 See Figure 4

Key: 1 Segment
2 Duration
3 Tone

| 階調 | セグメント1 1～6sf | セグメント2 7～12sf | セグメント3 13～18sf | セグメント4 19～24sf | セグメント5 25～30sf | セグメント6 31～36sf |
|---|---|---|---|---|---|---|
| 0～42 | 図26参照 | 全てオフ | 全てオフ | 全てオフ | 全てオフ | 全てオフ |
| 43～85 | 全てオン | 図27参照 | 全てオフ | 全てオフ | 全てオフ | 全てオフ |
| 86～127 | 全てオン | 全てオン | 図26参照 | 全てオフ | 全てオフ | 全てオフ |
| 128～170 | 全てオン | 全てオン | 全てオン | 図27参照 | 全てオフ | 全てオフ |
| 171～212 | 全てオン | 全てオン | 全てオン | 全てオン | 図26参照 | 全てオフ |
| 213～255 | 全てオン | 全てオン | 全てオン | 全てオン | 全てオン | 図27参照 |

Figure 25

Key: 1 Tone
2 Segment
3 All ON
4 All OFF
5 See Figure 26
6 See Figure 27

| 階調 (1) | セグメント1 (2) | | | | | |
|---|---|---|---|---|---|---|
| | 1sf | 2sf | 3sf | 4sf | 5sf | 6sf |
| 1 | 1t | | | | | |
| 2 | | 2t | | | | |
| 3 | 1t | 2t | | | | |
| 4 | | | 4t | | | |
| 5 | 1t | | 4t | | | |
| 6 | | 2t | 4t | | | |
| 7 | 1t | 2t | 4t | | | |
| 8 | | | | 8t | | |
| 9 | 1t | | | 8t | | |
| 10 | | 2t | | 8t | | |
| 11 | 1t | 2t | | 8t | | |
| 12 | | | 4t | 8t | | |
| 13 | 1t | | 4t | 8t | | |
| 14 | | 2t | 4t | 8t | | |
| 15 | 1t | 2t | 4t | 8t | | |
| 16 | | | | | 16t | |
| 17 | 1t | | | | 16t | |
| 18 | | 2t | | | 16t | |
| 19 | 1t | 2t | | | 16t | |
| 20 | | | 4t | | 16t | |
| 21 | 1t | | 4t | | 16t | |
| 22 | | 2t | 4t | | 16t | |
| 23 | 1t | 2t | 4t | | 16t | |
| 24 | | | | 8t | 16t | |
| 25 | 1t | | | 8t | 16t | |
| 26 | | 2t | | 8t | 16t | |
| 27 | 1t | 2t | | 8t | 16t | |
| 28 | | | 4t | 8t | 16t | |
| 29 | 1t | | 4t | 8t | 16t | |
| 30 | | 2t | 4t | 8t | 16t | |
| 31 | | | 4t | 8t | 16t | 11t |
| 32 | 1t | | 4t | | 16t | 11t |
| 33 | | 2t | 4t | | 16t | 11t |
| 34 | 1t | 2t | 4t | | 16t | 11t |
| 35 | | | | 8t | 16t | 11t |
| 36 | 1t | | | 8t | 16t | 11t |
| 37 | | 2t | | 8t | 16t | 11t |
| 38 | 1t | 2t | | 8t | 16t | 11t |
| 39 | | | 4t | 8t | 16t | 11t |
| 40 | 1t | | 4t | 8t | 16t | 11t |
| 41 | | 2t | 4t | 8t | 16t | 11t |
| 42 | 1t | 2t | 4t | 8t | 16t | 11t |

Figure 26

Key: 1 Tone
2 Segment

| 階調 1 | セグメント2 2 | | | | | |
|---|---|---|---|---|---|---|
| | 7sf | 8sf | 9sf | 10sf | 11sf | 12sf |
| 43 | 1t | | | | | |
| 44 | | 2t | | | | |
| 45 | 1t | 2t | | | | |
| 46 | | | 4t | | | |
| 47 | 1t | | 4t | | | |
| 48 | | 2t | 4t | | | |
| 49 | 1t | 2t | 4t | | | |
| 50 | | | | 8t | | |
| 51 | 1t | | | 8t | | |
| 52 | | 2t | | 8t | | |
| 53 | 1t | 2t | | 8t | | |
| 54 | | | 4t | 8t | | |
| 55 | 1t | | 4t | 8t | | |
| 56 | | 2t | 4t | 8t | | |
| 57 | 1t | 2t | 4t | 8t | | |
| 58 | | | | | 16t | |
| 59 | 1t | | | | 16t | |
| 60 | | 2t | | | 16t | |
| 61 | 1t | 2t | | | 16t | |
| 62 | | | 4t | | 16t | |
| 63 | 1t | | 4t | | 16t | |
| 64 | | 2t | 4t | | 16t | |
| 65 | 1t | 2t | 4t | | 16t | |
| 66 | | | | 8t | 16t | |
| 67 | 1t | | | 8t | 16t | |
| 68 | | 2t | | 8t | 16t | |
| 69 | 1t | 2t | | 8t | 16t | |
| 70 | | | 4t | 8t | 16t | |
| 71 | 1t | | 4t | 8t | 16t | |
| 72 | | 2t | 4t | 8t | 16t | |
| 73 | 1t | 2t | 4t | 8t | 16t | |
| 74 | | | 4t | | 16t | 12t |
| 75 | 1t | | 4t | | 16t | 12t |
| 76 | | 2t | 4t | | 16t | 12t |
| 77 | 1t | 2t | 4t | | 16t | 12t |
| 78 | | | | 8t | 16t | 12t |
| 79 | 1t | | | 8t | 16t | 12t |
| 80 | | 2t | | 8t | 16t | 12t |
| 81 | 1t | 2t | | 8t | 16t | 12t |
| 82 | | | 4t | 8t | 16t | 12t |
| 83 | 1t | | 4t | 8t | 16t | 12t |
| 84 | | 2t | 4t | 8t | 16t | 12t |
| 85 | 1t | 2t | 4t | 8t | 16t | 12t |

Figure 27

Key: 1 Tone
2 Segment

Key: 1 Segment
2 Duration
3 Tone

| 階調 1 | セグメント1 2 | | | | | | | セグメント2 2 |
|---|---|---|---|---|---|---|---|---|
| | 1sf | 2sf | 3sf | 4sf | 5sf | 6sf | 7sf | 8sf |
| 0 | | | | | | | | 全てオフ 3 |
| 1 | 1t | | | | | | | |
| 2 | | 2t | | | | | | |
| 3 | 1t | 2t | | | | | | |
| 4 | | | 4t | | | | | |
| 5 | 1t | | 4t | | | | | |
| 6 | | 2t | 4t | | | | | |
| 7 | 1t | 2t | 4t | | | | | |
| 8 | | | | 8t | | | | |
| 9 | 1t | | | 8t | | | | |
| 10 | | 2t | | 8t | | | | |
| 11 | 1t | 2t | | 8t | | | | |
| 12 | | | 4t | 8t | | | | |
| 13 | 1t | | 4t | 8t | | | | |
| 14 | | 2t | 4t | 8t | | | | |
| 15 | 1t | 2t | 4t | 8t | | | | |
| 16~31 | (same as 0~15) | | | | 16t | | | |
| 32~63 | (same as 0~31) | | | | | 32t | | |
| 64~127 | (same as 0~64) | | | | | | 64t | |
| 128~255 | (same as 0~127) | | | | | | | 128t |

Figure 30 PRIOR ART

Key: 1 Tone
2 Segment
3 All OFF

Key: 11 DMD element
12 Color filter
13 Lamp
14 Projecting lens
a Memory
b Data format unit
c DMD control driver Key: 1 Pixel

TONE DISPLAY METHOD

CROSS REFERENCE TO PRIOR APPLICATIONS

This application claims priority based upon Provisional Application Serial No. 60/122,845, filed Mar. 4, 1999, the contents of which are incorporated herein by reference.

FIELD OF THE INVENTION

This invention relates to a tone display method of a display device using the "subfield method", such as a plasma display panel (PDP), digital mirror device (DMD) and the like which has a binary memory and displays plural binary images repeatedly in time, with half-tone moving images weighted individually.

BACKGROUND AND BRIEF DESCRIPTION OF THE PRIOR ART

The conventional subfield method is used in a display device having a binary (ON/OFF) memory in order to display half-tone images as shown in Japanese Kokai Patent Application No. Hei 4 [1992]-195,087, the contents of which are incorporated herein by reference and which corresponds to U.S. Pat. No. 5,317,334. FIGS. 29 and 30 illustrate such a display method with FIG. 31 showing one DMD element and a rotary color filter used to display the red, green and blue colors in order to realize color display and to display 8-bit, 256-tone TV images.

As shown in FIG. 31, there is provided a lamp 13 which directs light through a disk-shaped color filter 12 to a DMD 11 with light being reflected from the DMD 11 through a projecting lens 14. The DMD 11 is a collection of minute mirrors, each of which mirrors can be turned ON (lit or angled to pass light through lens 14) or OFF (unlit or angled not to pass light through lens 14) to create a display in well known manner. The mirrors of the DMD are controlled by a DMD control driver (c) from data collected in a memory (a) under control of a data format unit (b) at very high speed.

In the above described conventional 8-bit example, each image field (each field) comprises eight binary sub-images (subfields or sf) as shown in FIGS. 29 and 30. For the duration of each subfield as shown in FIG. 29, a weight corresponding to the brightness of one color when the subfield alone is ON is applied. In the case of the embodiment shown in FIG. 31, this weight corresponds to the time when a mirror of DMD 11 is ON or corresponds to the number of ON pulses during this time duration. In the example shown in FIGS. 29 and 30, the subfields have weights (brightness) of "1", '2', "4", "8", "16", "32" and "128" according to the binary scheme. That is, the subfields have durations of "1", '2', "4", "8", "16", "32", "64" and "128" times the unit time duration "t". As shown in FIG. 30, the pixels of the DMD display the half tone by a combination of certain subfields that are turned ON. For example, the brightness corresponding to "173" can be obtained by turning on the following subfields: subfield No. 8 having a weight of "128", subfield No. 6 having a weight of "32", subfield No. 4 having a weight of "8", subfield No. 3 having a weight of "4" and subfield No. 1 having a weight of "1". In the following explanation and with reference to the figures, subfield No. 1, subfield No. 2, etc. are denoted as "1sf", "2sf", etc.

For a still picture, the line of sight is nearly fixed. Consequently, for the various pixels, integration of the subfields can be carried out normally, so that there is no degradation in image quality. By adopting this driving method, it is also possible to display the tone for mirrors and other elements for which only the binary states of ON/OFF can be obtained.

A problem with the above described prior art display method using the conventional subfield method, as set forth in the reference "Pseudo shadow-like noise observed on pulse width modulated moving image display" (Japanese Title), which is synonymous with "New Category Contour Noise Observed in Pulse-Width-Modulated Moving Images" (English Title), Television Gakkai Gijutsu Hokoku, Vol. 19, No. 2, IDY95-21, pp. 61–66, is that pseudo shadow-like noise unique to moving images is observed and the image quality deteriorates. This is a disadvantage and is caused by the fact that, for moving images, the eyes must follow the images. Therefore, the time integration region of the eyes varies in space (i.e., when the line of sight moves at a speed equal to movement of plural pixels within one field of display period, integration of the subfields is carried out striding over plural pixels instead of within a single pixel). Consequently, it is impossible to obtain a normal image and the image quality degrades.

FIG. 36 is a diagram illustrating the aforementioned problem with respect to the extreme case of the tone display method shown in FIGS. 29 and 30. Pixel A and pixel B are set adjacent to each other and display tone 127 and 128 in the tone display method shown in FIGS. 29 and 30. That is, pixel A is ON for 1sf–7sf and is OFF only for 8sf while pixel B is OFF for 1sf–7sf and is ON only for 8sf. In FIG. 36, the pixel direction is the vertical direction and the subfields direction is the horizontal direction. That is, the vertical direction in FIG. 36 indicates the movement of the viewpoint in space, while the horizontal direction indicates the movement of the viewpoint in time. In this case, assuming the viewpoint does not move from pixel A (arrow c), the integration value of one field of pixel A becomes tone 127 as displayed. However, when the viewpoint moves from pixel A to pixel B at the speed of two pixels in one field (arrow a), the integration values of pixel A and pixel B can both be taken as tone 255. Also, when the viewpoint moves from pixel B to pixel A at a speed of two pixels in one field (arrow b), the integration values of pixel A and pixel B can both be taken as tone 0.

As shown in FIG. 32, in order to make quantitative measurement of the actual degree of degradation in the image quality, the image of a moving ramp waveform as viewed when the conventional subfield method is used for display is simulated on a computer. In this simulation method, the integration over time of the eyes in the case of movement to the left side at a speed of 8 pixels during each field display period is computed.

The ramp waveform should be a straight oblique line. However, in the conventional method, as the line of sight changes in the pixels form "127" to "128" and form "63" to "64", significant noise appears at these sites where new bits appear in the binary display. For the actual images, this leads to pseudo shadow-like degradation in the image quality.

As explained above, for tone quality using the conventional subfield method, when the image is viewed as the image moves, there may be unnatural appearances with a significant difference in brightness between pixels which should have little difference in brightness, this presenting a problem.

When the conventional subfield method is adopted to solve the aforementioned problem, it has been proposed that division of the subfields should be finer and the duration of each subfield should be approximately equal to the shortest subfield ("1t" in the tone display method shown in FIGS. 29 and 30). However, an increase in the number of subfields leads to an increase in memory requirement and an increase in power consumption. Consequently, when fine division into subfields is utilized randomly, the cost is increased significantly. As a result, there is a demand for a tone display method which can prevent degradation in the image quality of moving images without increasing cost by suppressing an increase in the number of subfield divisions.

A major purpose of this invention is to solve the aforementioned problems of the conventional technology by providing a tone display method characterized by preventing degradation in image quality of moving images without increasing cost when the subfield method is utilized.

SUMMARY OF THE INVENTION

In order to solve the problem as described hereinabove, there is first provided a tone display method wherein the time band corresponding to one prescribed color within one frame/field includes plural time-shared time bands. Time segments corresponding to the time-shared time bands are set. Each of the time segments includes one or several subfields. The tone of the prescribed one color is displayed by appropriately setting the various subfields to ON/OFF. The time segments have a mixture of the subfields in the ON state and the subfields in the OFF state which are assigned the number 0 or 1 while the remaining segments contain all the subfields in an ON state or all the subfields in an OFF state. In the case of a continuous change of tone in the display, priority is given to changing the ON/OFF state of the subfields within the same segment. In the case of a change of display with 1-tone difference, (except when the number of that segment with a mixture of the subfields in the ON state and the subfields in the OFF state is 0 before the display change) for the segment made of plural ones of the subfields, a change is not provided from the segment containing only the subfields in the ON state to one containing only the subfields in the OFF state and a change from the segment containing only the subfields in the OFF state to one containing only the subfields in the ON state.

In accordance with a second embodiment of the invention pertaining to the tone display method of the above described portion of the invention, in the case of a continuous change of tone in the display, the segment is selected according to the order in time of the segments for changing of the ON/OFF state of the subfields.

In accordance with a third embodiment of the invention, the tone display in the above described first and second embodiments of the invention, for each subfield, the value obtained by dividing the brightness obtained when all of the subfields corresponding to the prescribed one color are ON with the the tone number is defined as a unit and the subfield has a weight corresponding to the brightness of the prescribed one color obtained when only the subfield is ON, all or a portion of the plural subfields of each segment are n+1 (n is a prescribed natural number) subfields, each of the subfields being a binary subfield having a weight $2^0$, $2^1$, . . . , $2^n$ times the one unit. When a continuous change of tone in the display is performed, the ON/OFF switch of various ones of the binary subfields is carried out in an order of priority corresponding to $2^0$, $2^1$, . . . , $2^n$.

In accordance with a fourth embodiment of the invention, the tone display of the third portion, a portion of the plural subfields of each segment is the adjustment subfield, this being a subfield other than the a binary subfield. When a continuous change of tone in the display is carried out, the changing of ON/OFF states between the binary subfields is carried out with priority in the changing of ON/OFF states of the adjustment subfield.

In accordance with a fifth embodiment of the invention, in the tone display of the fourth embodiment, each segment has only one adjustment subfield, that adjustment subfield having a weight identical to the one unit.

In accordance with a sixth embodiment of the invention, the weight in the tone display method of the above discussed embodiments of the invention is a duration which takes the time obtained by dividing the time corresponding to the one color in the one frame/field with the tone number as a unit.

In accordance with a seventh embodiment of the invention, when the subfield in accordance with the sixth embodiment of the invention has a duration shorter than the load time of data of each subfield, for each segment, subfields having a duration which is less than twice the load time are not set continuously in time.

In accordance with an eighth embodiment of the invention, when the subfield of the sixth or seventh embodiments has a duration less than the load time of data of each subfield, for each segment, a subfield having a duration less than twice the load time is set at the leading edge and/or at the trailing edge in time.

With the above-described construction, it is possible to prevent generation of abnormal images caused by addition of subfields due to movement in the line of sight and to improve image quality of the moving images without increasing cost.

BRIEF DESCRIPTION OF THE DRAWINGS

FIG. 3 is a table illustrating the selection of subfields for tones 0 to 42 in the tone display method in accordance with the first embodiment of the invention;

FIG. 4 is a table illustrating the selection of subfields for tones 43 to 85 in the tone display method in accordance with the first embodiment of the invention;

FIG. 5 is a table illustrating the selection of subfields for tones 86 to 127 in the tone display method in accordance with the first embodiment of the invention;

FIG. 6 is a table illustrating the selection of subfields for tones 128 to 170 in the tone display method in accordance with the first embodiment of the invention;

FIG. 7 is a table illustrating the selection of subfields for tones 171 to 212 in the tone display method in accordance with the first embodiment of the invention;

FIG. 8 is a table illustrating the selection of subfields for tones 213 to 255 in the tone display method in accordance with the first embodiment of the invention;

FIG. 11 is a table illustrating the selection of segments in accordance with the second embodiment in accordance with the present invention;

FIG. 12 is a table illustrating the selection of subfields for segments 1, 3 and 5 in the tone display method in accordance with the second embodiment in accordance with the present invention;

FIG. 13 is a table illustrating the selection of subfields for segments 2, 4 and 6 in the tone display method in accordance with the second embodiment in accordance with the present invention;

FIG. 15 is a table illustrating the selection of segments in the tone display method in accordance with the third embodiment in accordance with the present invention;

FIG. 16 is a table illustrating the selection of subfields for segments 1 to 7 in the tone display method in accordance with the third embodiment in accordance with the present invention;

FIG. 17 is a table illustrating the selection of subfields for segment 8 in the tone display method in accordance with the third embodiment in accordance with the present invention;

FIG. 19 is a table illustrating the selection of segments in the tone display method in accordance with the fourth embodiment in accordance with the present invention;

FIG. 20 is a table illustrating the selection of subfields for segments 1 to 3 in the tone display method in accordance with the fourth embodiment in accordance with the present invention;

FIG. 21 is a table illustrating the selection of subfields for segment 4 in the tone display method in accordance with the fourth embodiment in accordance with the present invention;

FIG. 22 is a table illustrating the selection of segments in the tone display method in accordance with a fifth embodiment in accordance with the present invention;

FIG. 23 is a table illustrating the selection of segments in the tone display method in accordance with a sixth embodiment in accordance with the present invention;

FIG. 25 is a table illustrating the selection of segments in the tone display method in accordance with the seventh embodiment in accordance with the present invention;

FIG. 26 is a table illustrating the selection of subfields for segments 1, 3 and 5 in the tone display method in accordance with the seventh embodiment in accordance with the present invention;

FIG. 27 is a table illustrating the selection of subfields for segments 2, 4 and 6 in the tone display method in accordance with the seventh embodiment in accordance with the present invention;

FIG. 30 is a table illustrating the selection of subfields in accordance with the prior art conventional tone display method;

DESCRIPTION OF THE PREFERRED EMBODIMENTS

Figure 1:
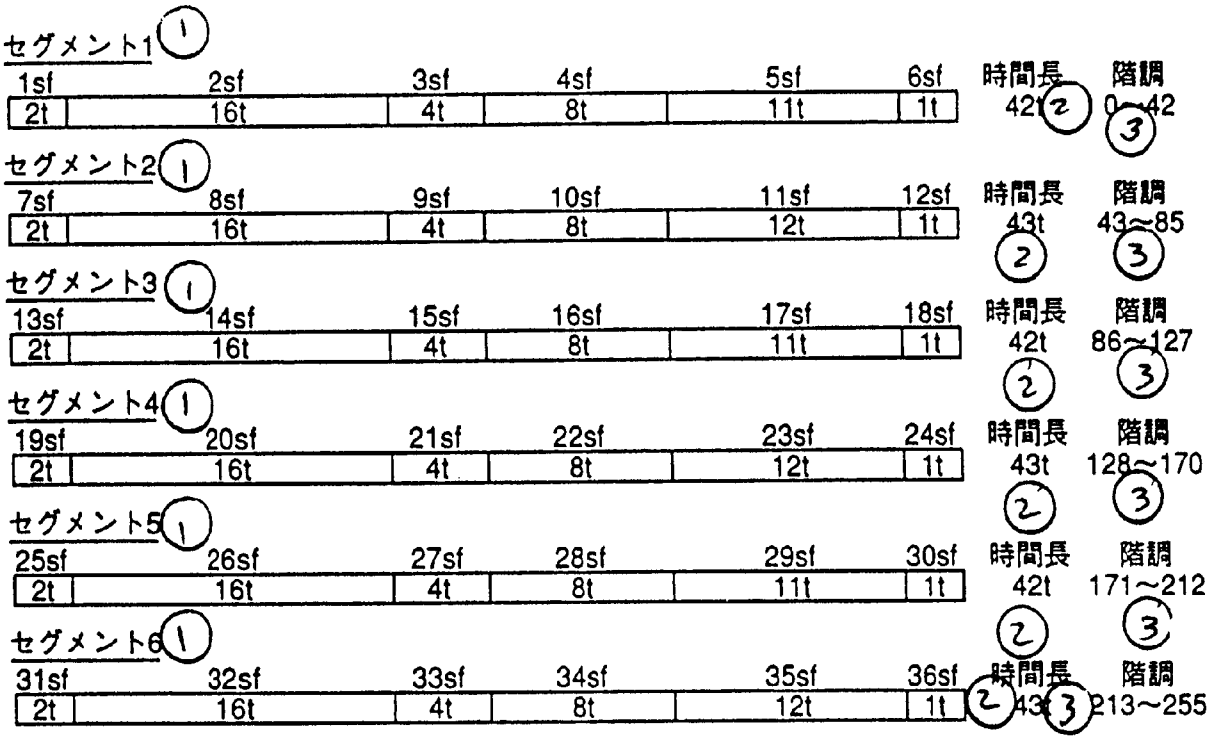
FIG. 1 is a diagram illustrating the configuration of the subfield in the tone display method in accordance with a first embodiment of the invention.
Figure 2:
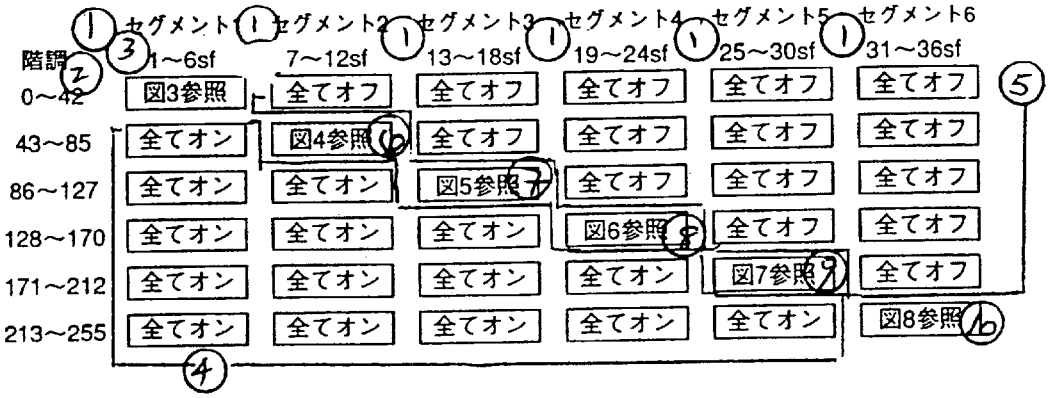
FIG. 2 is a table illustrating the selection of segments in the tone display method in accordance with the first embodiment of the invention.
Figure 31:
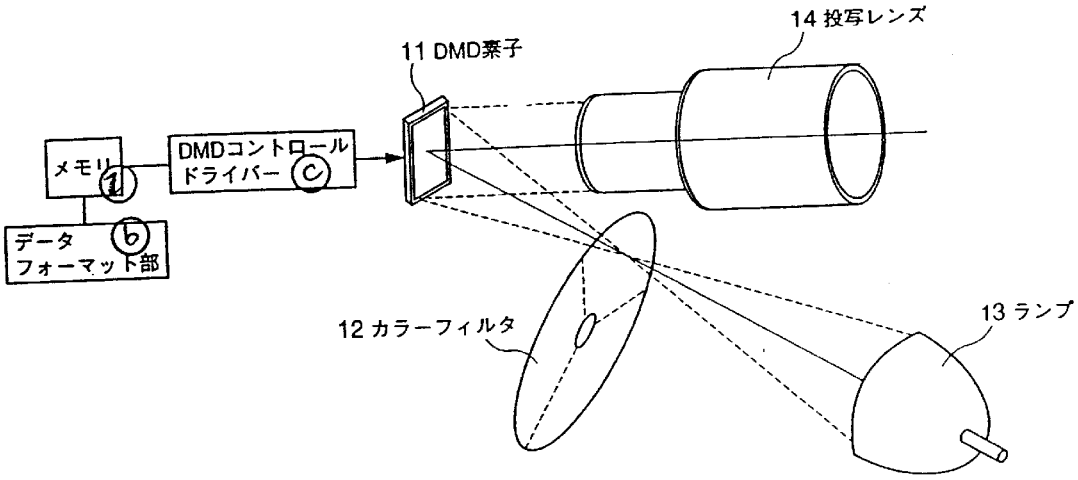
Figure 31 PRIOR ART
FIG. 31 is a diagram illustrating the configuration of a projecting display device using a DMD in accordance with the prior art.

Referring first to FIGS. 1 to 8, there is illustrated the tone display method in accordance with the first embodiment of the present invention. In the tone display method of the first embodiment, 8-bit images (i.e., images having 256 tone levels) are displayed. FIG. 1 illustrates the structure of the subfield wherein segment 1 includes subfields (sf) with the duration 2 of each subfield shown as a number multiplied by t and the tone 3. FIG. 2 is a table illustrating which segments 1 are turned ON with respect to the tone 2. FIGS. 3 to 8 are tables illustrating which subfields are turned ON with respect to the tone 2 in each segment 1. When the box corresponding to each subfield contains characters indicating the duration of the subfield, it indicates that the subfield is lit or ON. When that box is empty, it indicates that the subfield in not lit or OFF. In this embodiment, the tone display method is in the same projecting type device as that in the conventional method shown in FIG. 31. One DMD element is used and a color filter divided into RGB is rotated so that the fields of red color, green color and blue color are displayed in order and a color display is obtained. In this embodiment, the color filter with equal angles of RGB is rotated for six cycles in each field period. Consequently, each color has 6 segments of separated light emitting periods (corresponding to the "time-shared time bands" in this invention). In addition, FIGS. 1 to 8 show the configuration diagrams of the subfields of the green color alone. Segments 1 to 6 have equal time and a gap corresponding to one segment of each of red color (R) and blue color (B) is left between the segments.

Figure 29:
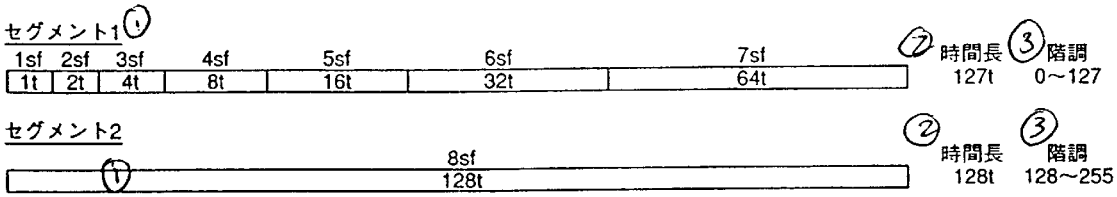
Figure 29 PRIOR ART
FIG. 29 is a diagram illustrating the configuration of the subfield in accordance with the prior art conventional tone display method.

Similar to FIG. 29 illustrating the prior art, in FIG. 1, the duration of each subfield is weighted corresponding to the brightness of one color when the subfield alone is turned ON. In the configuration shown in FIG. 31, this weighting corresponds to time when the mirror of the DMD is lit or ON or corresponds to the number of pulses for turning ON during the duration. In this embodiment, each field is displayed by 36 subfields, eight-bit "256" tones are almost evenly allocated to six segments and allocation is provided such that the segments 1 through 6 have durations of "42t", "43t", "42t", "43t", "42t" and "43t", respectively. Here, t represents the basic time (corresponding to "one unit") as the time displaying the green color (G) in one field time is divided by the 256 tones.

In this embodiment, as shown in FIG. 2, for tones "0" through "42", display is carried out using the subfields in segment 1 (in this case, all of the subfields in the other segments are OFF and for tones "43" through "85", the tone display is carried out using the subfields in segment 1 (in this case, all of the subfields of segment 1 are normally ON and all of the subfields of segment 3 and later segments are not lit). In this way, the display of a certain tone is completed sequentially for each segment. Then, display of the next tone is performed by the next segment, and display is performed by continuous time width modulation.

As shown in FIGS. 3 to 8, in each segment, the duration of "42t" (or "43t") is divided into six subfields having durations of "11t" (or "12t"), "16t", "8t", "4t", "2t" and "1t", respectively. By means of a combination of ON/OFF subfields, the variation in the tone corresponding to the segment is displayed. As an example, explanation may be made with reference to segment 1. In this case, among the tones of "0" through "42", for tones from "0" to "31" display is made using the binary method by means of five subfields having durations of "16t", "8t", "4t", "2t" and "1t", respectively. For the tones of "32" through "42", display is made by normally lighting the two subfields having durations of "11t" and "16t" and by means of the binary method using the remaining four subfields having durations of "8t", "4t", "2t" and "1t", respectively. Similarly, for segments 2 through 6, by means of a combination of ON/OFF subfields that form each segment, the variation in the tone corresponding to the segment is displayed. The subfields having durations of "11t" and "12t" correspond to the "adjustment subfields" in this invention and the subfields having durations of "16t", "8t", "4t", "2t" and "1t" correspond to the "binary subfields" in this invention. That is, in each case as the tone is increased by 42 (or 43), for segments 1 through 6 sequentially, the subfields in each segment are lit so that the tone is increased continuously. In each segment, display is performed mostly according to the binary method for the subfields such that the display is completed within the segment.

Figure 9:
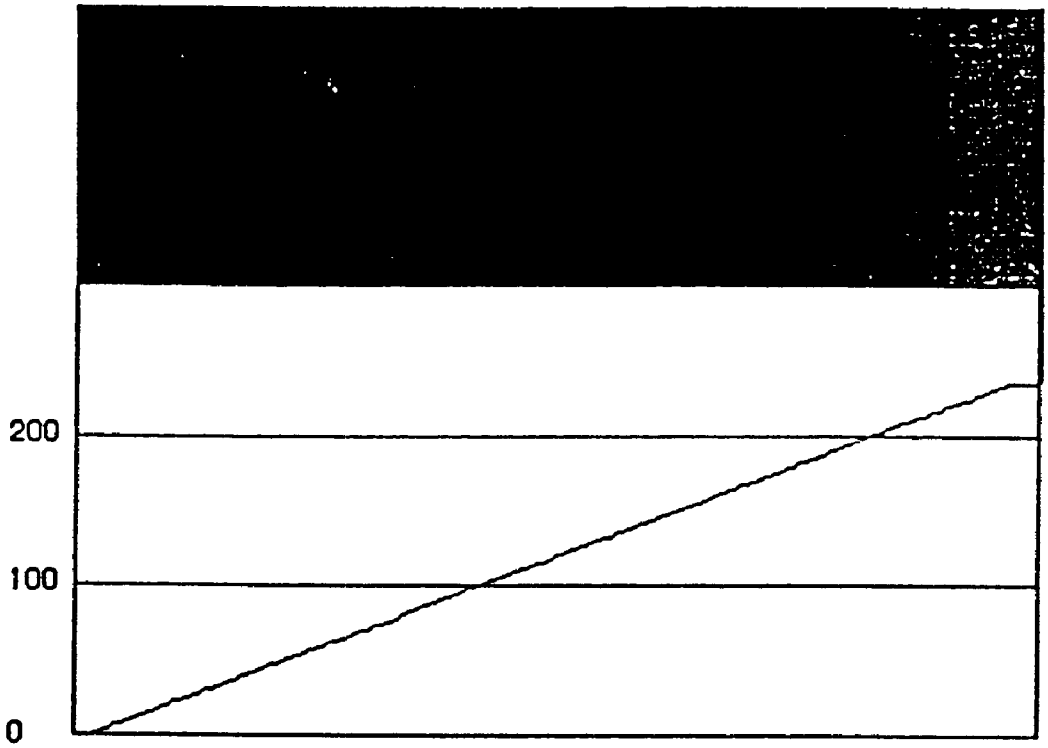
FIG. 9 is a diagram illustrating the results of simulating an image when a ramp waveform moves using the tone display method in accordance with the first embodiment of the invention.
Figure 32:
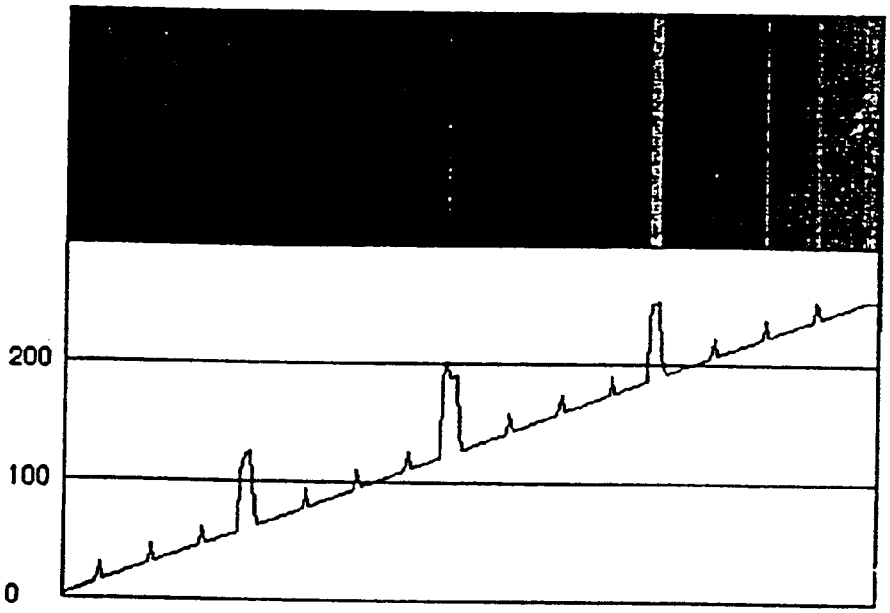
Figure 32 PRIOR ART
FIG. 32 is a diagram illustrating the results of simulating an image when a ramp waveform moves using the conventional prior art tone display method.

FIG. 9 is a diagram illustrating the computer simulation of the image of a moving ramp waveform when it is displayed using the tone display method in the first embodiment of the invention. The simulation method is the same as that explained for the prior art. That is, when the eyes of the observer move to the left side at a speed of 8 pixels during each field display period, the integration over time for the eyes is computed. When the waveform shown in FIG. 9 is compared with the waveform shown in FIG. 32, when the line of sight changes from the pixel having tone of "127" to that of "128" or from : "63" to "64", that is, at sites where new bits arise in the binary display, the noise can be alleviated significantly. In this way, it is possible to make significant improvement to alleviate the pseudo shadow-like image degradation in moving images.

In the above, the state of this embodiment has been explained with reference to the subfields of the color green as an example. For the colors red and blue, the same method may be adopted to make significant improvement against degradation in the image quality for moving images.

In the aforementioned state of this embodiment, the configuration of the subfields of each segment is taken as six subfields having durations of "11t" (or "12t"), "16t", "8t", "4t", "2t" and "1t", respectively. However, the same effect can be realized when "8t", "4t", "2t " and "1t" are maintained the same while the remaining "27t" (or "28t") is divided into two subfields having weights of "10t" and "17t " or "13t" and "14t", etc. In this case, the subfields, for which it is impossible to display a portion of the change in the tone that takes place within one segment, are excluded. In this embodiment, for the segment having a duration of "42t" as an example, the binary subfields of this invention are taken as the four subfields having duration of "8t", "4t", "2t" and "1t" and for the combination of subfields corresponding to the adjustment subfields of this invention, such as the combination of "22t" and "5t", for which the difference in the duration is larger than "16t", the subfield configuration corresponds to the aforementioned excluded configuration.

Figure 33:
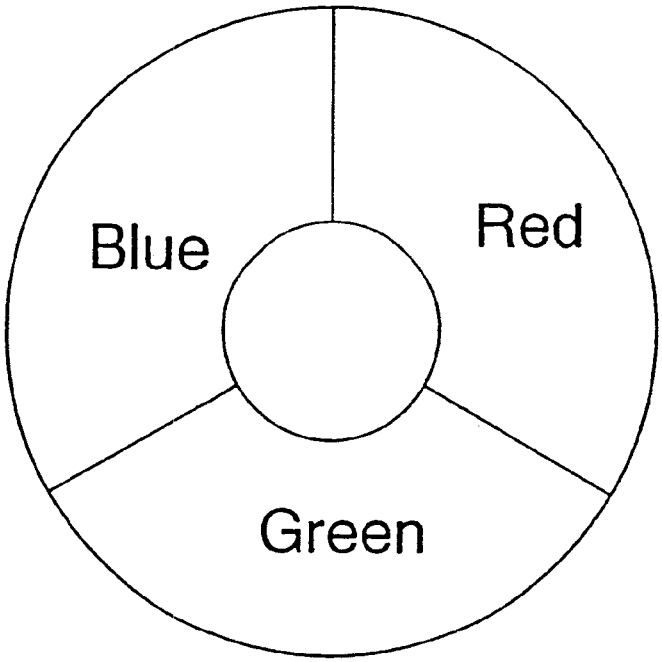
FIG. 33 is a schematic diagram illustrating a color filter using the tone display method in accordance with the first embodiment in accordance with the present invention.
Figure 34:
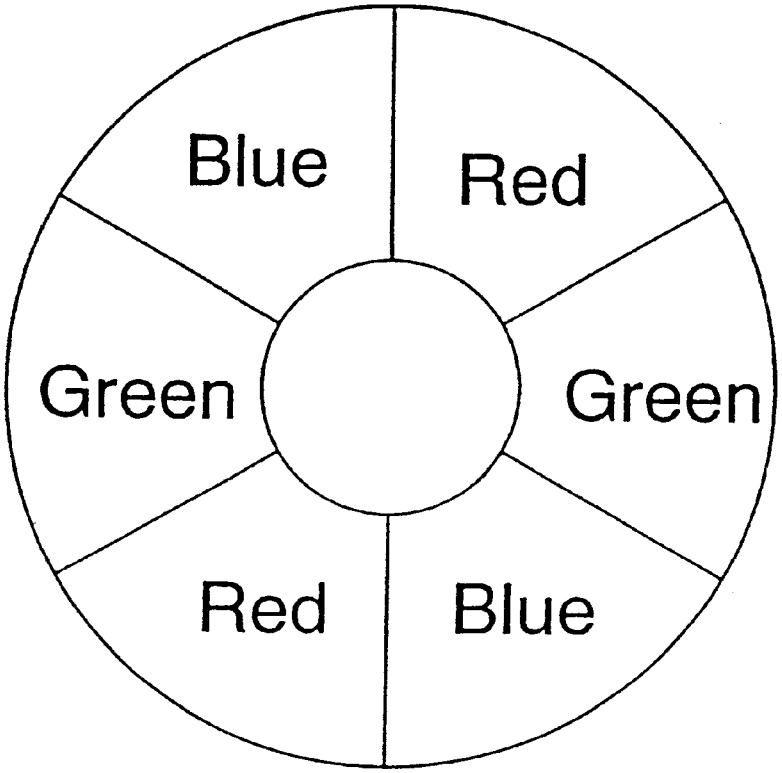
FIG. 34 is a schematic diagram illustrating a modified example of a color filter using the tone display method in accordance with the first embodiment in accordance with the present invention.

In this embodiment, as shown in FIG. 33, a color filter with equal sections of RGB is rotated for six cycles in the period of one field. However, this invention is not limited to this configuration. As shown in FIG. 34, the same effect can be realized by a color filter evenly divided into six portions of RGBRGB and made to rotate by three cycles for each field, or by a color filter evenly divided into nine portions of RGBRGBRGB and made to rotate by two cycles for each field, or by a color filter evenly divided into eighteen portions of RGB . . . RGB and made to rotate by one cycle for each field.

Figure 10:
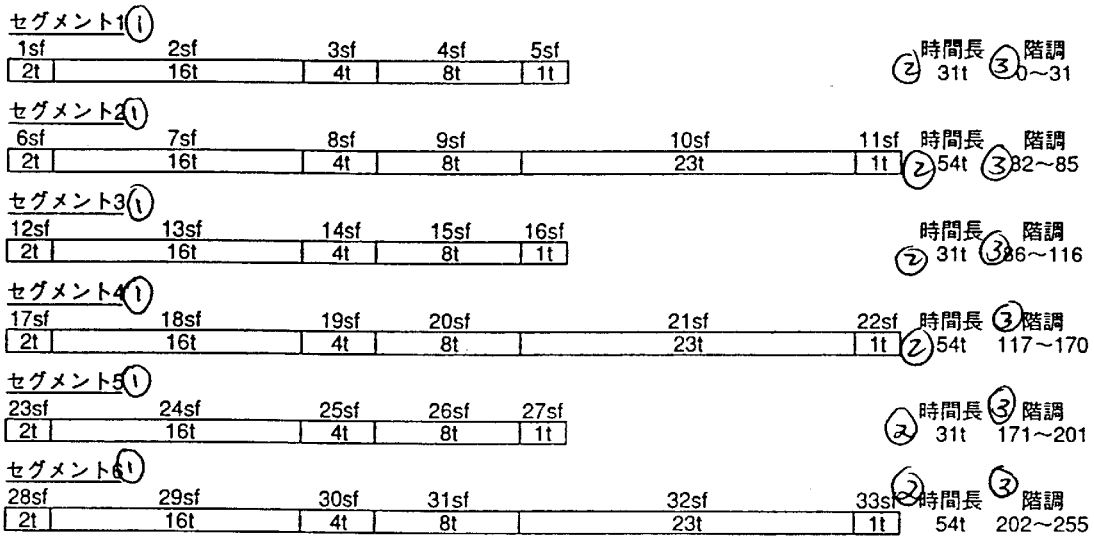
FIG. 10 is a diagram illustrating the configuration of the subfields in the tone display method in accordance with a second embodiment in accordance with the present invention.
Figure 35:
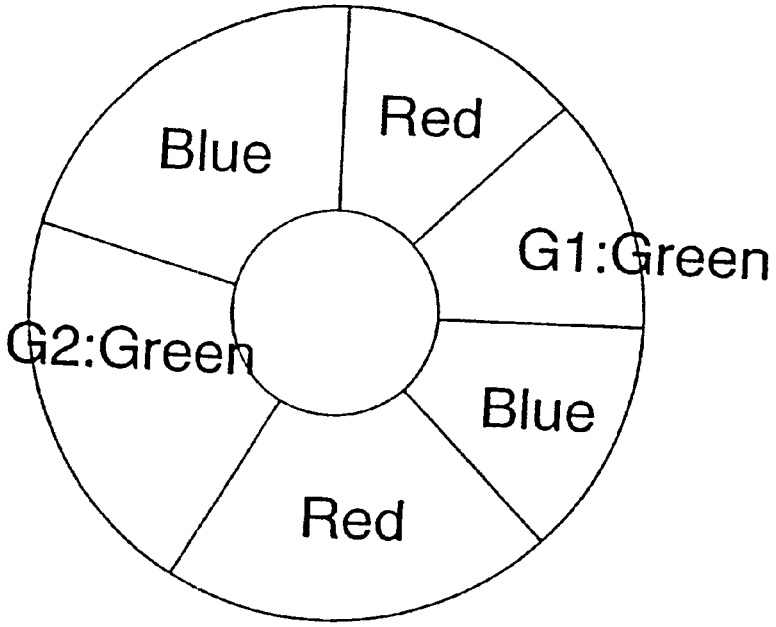
FIG. 35 is a schematic diagram illustrating a modified example of a color filter using the tone display method in accordance with the second embodiment in accordance with the present invention.
Figure 36:
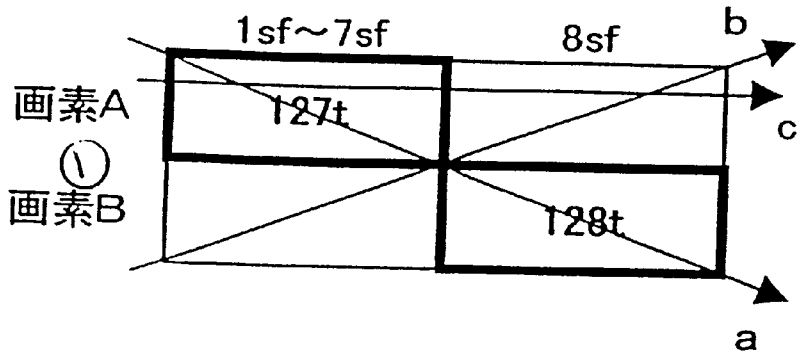
Figure 36 PRIOR ART
FIG. 36 is a diagram illustrating the movement in the viewpoint between pixels displaying the tone in the conventional prior art tone display method.

In accordance with the second embodiment of the invention, FIGS. 10 to 13 are diagrams illustrating the tone display method in accordance with this embodiment. As in the tone display method of the first embodiment, a case of displaying eight-bit images (images having 256 tone levels) is also presented as an example for the tone display method in this embodiment. FIG. 10 is a diagram illustrating the configuration of the subfields. FIG. 11 is a table illustrating which segments are turned ON with respect to the tone. FIGS. 12 and 13 are tables illustrating which subfields are turned ON with respect to the tone in each segment. When the box corresponding to each subfield contains characters indicating the duration of the subfield, it indicates that the subfield is ON and when nothing is filled in it indicates that the subfield is OFF. In this embodiment, just as in the conventional method shown in FIG. 31, one DMD element is used and a color filter divided into RGB is rotated so that the fields of red, green and blue are displayed in order and a color display is obtained. In this embodiment, the color filter divided into six divisions of RGBRGB as shown in FIG. 35 is rotated three cycles in each field period. Consequently, each color has six segments of separated light emitting periods (corresponding to the "time-shared time bands" in this invention). As shown in FIG. 35, there is a difference in the angle site of the GI portion and the G2 portion of the color green. In addition, FIGS. 10 to 13 show the configuration diagrams of the subfields of the green color alone. For the times of the various segments from segment 1 to segment 6, there is a difference in time corresponding to the angle of the color filter.

Similar to FIG. 29 illustrating the prior art, in FIG. 10, the duration of each subfield is weighted corresponding to the brightness of one color when the subfield alone is turned ON. In the configuration shown in FIG. 31, this weighting corresponds to time when the mirror of the DMD is ON, or corresponds to the number of pulses for turning ON during the duration. In this embodiment, each field is displayed by thirty-three subfields. Eight-bit, 256 tones are allocated to six segments proportional to time and allocation is made such that segments 1 through 6 have durations of "31t", "54t", "31t", "55t", "31t" and "54t", respectively. Here, t represents the basic time (corresponding to "one unit" in this invention) as the time displaying the green color in one field time is divided by the 256 tones.

In this embodiment, as shown in FIG. 11, for tones "0" through "31", the display is carried out using the subfields in segment 1 (in this case, all of the subfields in the other segments are OFF) and for tones "32" through "85" the tone display is carried out using the subfields in segment 2 (in this case, all of the subfields of segment 1 are normally ON and all of the subfields of segment 3 and later segments are not ON). In this way, the display is completed sequentially of a certain tone for each segment. Then, the display of the next tone is performed by the next segment and the display is performed by continuous time width modulation.

As shown in FIG. 12, in segments 1, 3 and 5 having a short duration, the duration of "31t" is divided into five subfields having durations of "16t", "8t", "4t", "2t" and "1t", respectively. By combining ON/OFF of these subfields in the binary manner, the variation in tone corresponding to the segment is displayed. This is, segments 1, 3 and 5 are made solely of the subfields corresponding to the "binary subfields" of this invention.

As shown in FIG. 13, for segments 2, 4 and 6 having a long duration, the duration of "54t" is divided into six subfields having durations of "23t", "16t", "8t", "4t", "2t" and "1t", respectively. By means of a combination of these subfields in an ON/OFF state, the variation in the tone corresponding to the segment is displayed. As an example, an explanation will be made with segment 2. In this case, among the tones of "32" through "85", for tones from "32" to "63", the display is made using the binary method by means of five subfields having durations of "16t", "8t", "4t", "2t" and "1t", respectively. For tones of "63" through "85", the display is made by normally lighting the two subfields having durations of "23t" and "16t" and for the remainder, display is performed by means of the binary method using the four subfields having durations of "8t", "4t", "2t" and "1t", respectively. Similarly, for segments 4 and 6, by means of a combination of the subfields in an ON/OFF state that form each segment, the variation in the tone corresponding to the segment is displayed. In segments 2, 4 and 6, the subfields having durations of "23t" correspond to the "adjustment subfields" in this invention and the subfields having durations of "16t", "8t", "4t", "2t" and "1t" correspond to the "binary subfields" in this invention.

That is, each time the tone is increased by 31 (or 54), for segments 1 through 6, sequentially, the subfields in each segment are lit so that the tone is increased continuously. In each segment, display is performed mostly according to the binary method for the subfields such that the display completes within the segment. In this way, almost the same effect as that of the first embodiment can be realized.

The relationship between the color filter and the segment configuration (subfield configuration) is not limited to the relationship between the color filter shown in FIG. 35 and the segment configuration (subfield configuration) shown in FIG. 10. The following scheme may also be used. Segment division is carried out corresponding to the division of the color filter. The value of the segments with mixed ON subfields and OFF subfields is assigned 0 or 1, while the remaining segments are made of only ON subfields alone or only OFF subfields. When the continuous change of a segment display is carried out, priority goes to the subfields in the same segment that are changing from ON/OFF. When the change of display is performed with 1-tone difference, except when the value of the segment with a mixture of subfields in the ON state and subfields in the OFF state is 0 before the display switch, for the segment made of plural said subfields, switch from the segment made only of the subfields in the ON state to one made only of the subfields in the OFF state, and switch from the segment made only of the subfields in the OFF state to one made only of the subfields in the ON state is not done in this segment configuration (subfield configuration).

Figure 14:
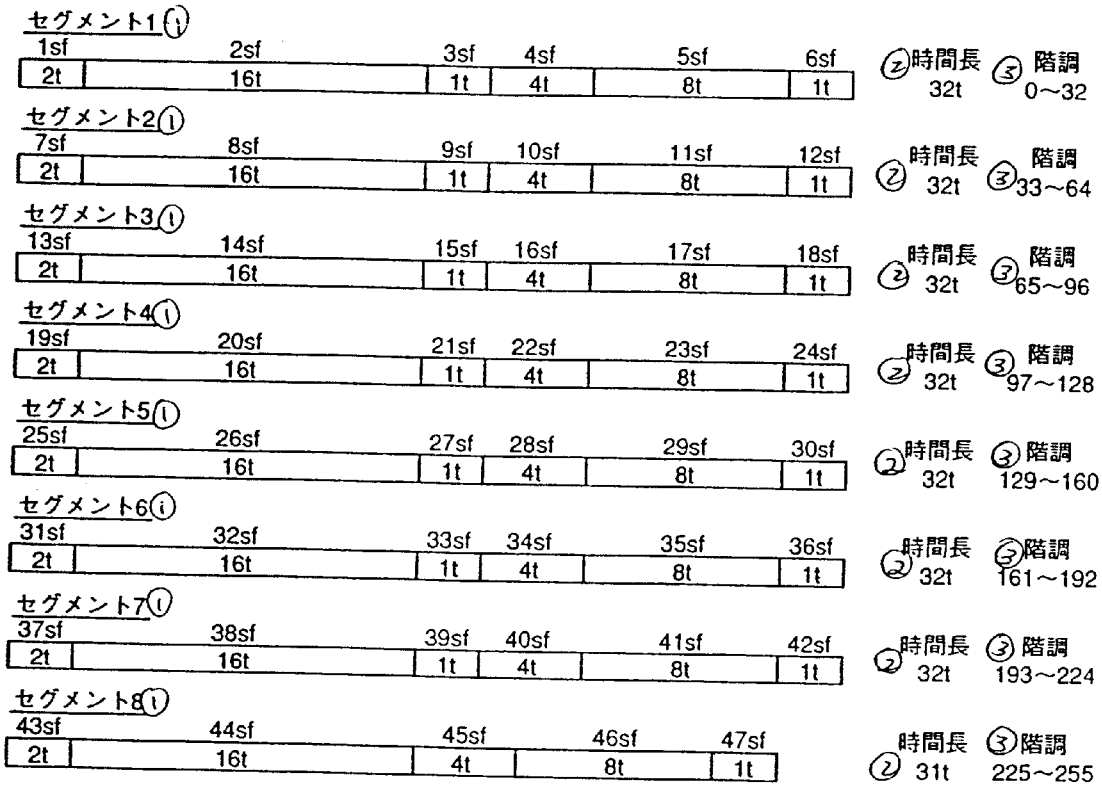
FIG. 14 is a diagram illustrating the configuration of the subfields in the tone display method in accordance with a third embodiment in accordance with the present invention.

In accordance with the third embodiment of the invention, FIGS. 14–17 are diagrams illustrating the tone display method in the third embodiment of this invention. Just as in the tone display method in the first embodiment, a case of displaying 8-bit images, that is, images having 256 tone levels, is also presented as an example for the tone display method in this embodiment. FIG. 14 is a diagram illustrating the configuration of the subfields. FIG. 15 is a table illustrating which segments are turned ON with respect to the tone. FIGS. 16 and 17 are tables illustrating which subfields are turned ON with respect to the tone in each segment. When the box corresponding to each subfield contains characters indicating the duration of the subfield, it indicates that the subfield is lit (ON); when it is empty, it indicates that the subfield is not lit (OFF). In this embodiment, just as in the conventional method shown in FIG. 31, one DMD element is used, and a color filter divided into RGB is rotated, so that the fields of red color, green color and blue color are displayed in order, and a color display is obtained. In this embodiment, the color filter divided into RGB having equal angle size is rotated for 8 cycles in each field period. Consequently, each color has 8 segments of separated light emitting periods (corresponding to the "time-shared time bands" in this invention). In addition, FIGS. 14–17 show the configuration diagrams of the subfields of the green color alone. For the times of the various segments from segment 1 to segment 8, the times are equal to each other, and a gap corresponding to one segment each of R and B is left between the segments.

Similar to FIG. 29 illustrating the prior art, in FIG. 14, the duration of each subfield is weighted corresponding to the brightness of one color when the subfield alone is turned ON. In the configuration shown in FIG. 31, this weighting corresponds to the time when the mirror of the DMD is ON (lit), or corresponds to the number of pulses for turning the DMD ON during the duration. In this embodiment, each field is displayed by 47 subfields; 8-bit "256" tones are allocated such that segments 1 through 7 have a duration of "32t", and segment 8 has a duration of "31t". Here, t represents the basic time (corresponding to "one unit" in this invention) as the time displaying the green color in one field time is divided by 256 tones.

In this embodiment, as shown in FIG. 15, for tones "0" through "32", the display is carried out using the subfields in segment 1 (in this case, all of the subfields in the other segments are not lit (OFF)), and for tones "33" through "64", the tone display is carried out using the subfields in segment 2 (in this case, all of the subfields of segment 1 are normally lit (ON), and all of the subfields of segment 3 and later segments are not lit). In this way, the display is completed sequentially of a certain tone for each segment. Then, the display of the next tone is performed by the next segment, and the display is performed by continuous time width modulation. This feature is identical to the first embodiment.

As shown in FIG. 16, in the various segments except segment 8, during the duration of "32t", the duration of "31t" is divided into five subfields having durations of "16t", "8t", "4t", "2t" and "1t", respectively. By combining these ON/OFF subfields in the binary manner, the variation in the tone corresponding to the segment is displayed. Finally, by lighting the subfield having the duration of "1t" as the least significant bit, it is possible to display the brightness corresponding to the duration of "32t". In this way, for each tone "32" of segments 1 through 7, in a continuous manner, by means of a combination of subfields in an ON/OFF state that form each segment, the variation in the tone corresponding to the segment is displayed. Among the aforementioned segments, the subfields having the duration of "1t" and lit last correspond to the "adjustment subfields" of this invention, while the remaining subfields having durations of "16t", "8t", "4t", "2t" and "1t" correspond to the "binary subfields" of this invention.

As shown in FIG. 17, for displaying the final tones of "225" through "255", in segment 8, the duration of "31t" is divided into five subfields with durations of "16t", "8t", "4t", "2t" and "1t", respectively, using the binary method. That is, segment 8 is made only of the subfields corresponding to the "binary subfields" of this invention.

That is, each time the tone is increased by 32, for segment 1 through segment 8, sequentially, the subfields in each segment are lit so that the tone is increased continuously. In each segment, display is performed according to the binary method for the subfields such at the display is completed within the segment.

In this embodiment, when the tone is increased continuously, lighting of the subfields in the segment is performed using the binary method, except for lighting of the subfields having the duration of "1t" and lit as the last one in segments 1–7. This simplifies the configuration.

Figure 18:
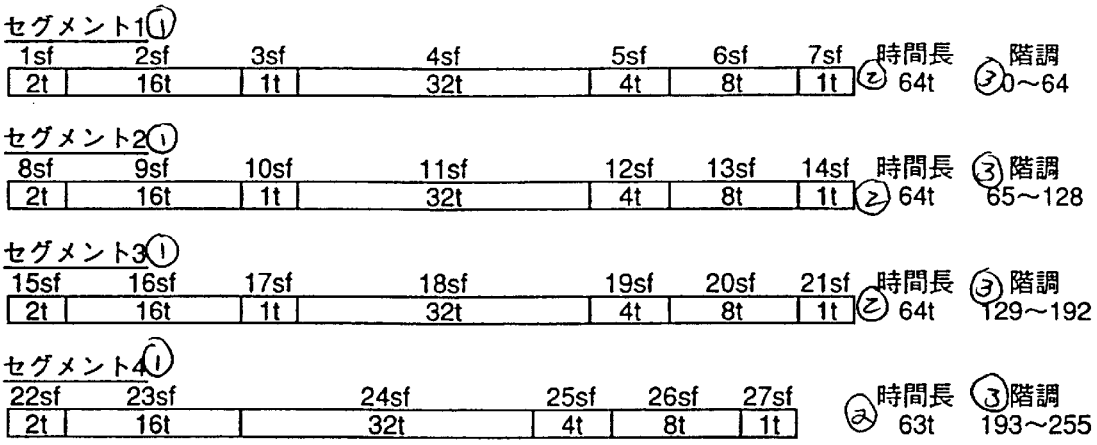
FIG. 18 is a diagram illustrating the configuration of the subfields in the tone display method in accordance with a fourth embodiment in accordance with the present invention.

In accordance with the fourth embodiment of the invention, FIGS. 18–21 are diagrams illustrating the tone display method in the fourth embodiment of this invention. Just as in the tone display method in the first embodiment, a case of displaying 8-bit images, that is, images having 256 tone levels, is also presented as an example for the tone display method in this embodiment. FIG. 18 is a diagram illustrating the configuration of the subfields. FIG. 19 is a table illustrating which segments are turned ON with respect to the tone. FIGS. 20 and 21 are tables illustrating which subfields are turned ON with respect to the tone in each segment. When the box corresponding to each subfield contains characters indicating the duration of the subfield, it indicates that the subfield is lit (ON); when it is empty, it indicates that the subfield is not lit (OFF). In this embodiment, just as in the conventional method shown in FIG. 31, one DMD element is used, and a color filter divided into RGB is rotated, so that the fields of red color, green color and blue color are displayed in order, and a color display is obtained. In this embodiment, the color filter divided into RGHB having the same angle is rotated for 4 cycles in each field period. Consequently, each color has 4 segments of separated light emitting periods (corresponding to the "time-shared time bands" in this invention). In addition, FIGS. 18–21 show the configuration diagrams of the subfields of the green color alone. For the times of the various segments from segment 1 to segment 4, the times are equal to each other, and a gap corresponding to one segment each of R and B is left between the segments.

Similar to FIG. 29 illustrating the prior art, in FIG. 18, the duration of each subfield is weighted corresponding to the brightness of one color when the subfield alone is turned ON. In the configuration shown in FIG. 31, this weighting corresponds to the time when the mirror of the DMD is ON (lit), or corresponds to the number of pulses for turning the DMD ON during the duration. In this embodiment, each field is displayed by 27 subfields; 8-bit "256" tones are allocated such that segments 1 through 3 have the duration of "64t", and segment 4 has a duration of "63t". Here, t represents the basic time (corresponding to "one unit" in this invention) as the time displaying the green color in one field time is divided by the 256 tones.

In this embodiment, as shown in FIG. 19, for tones "0" through "64", display is carried out using the subfields in segment 1 (in this case, all of the subfields in the other segments are not lit (OFF)), and for tones "65" through "128", the tone display is carried out using the subfields in segment 2 (in this case, all of the subfields of segment 1 are normally lit (ON), and all of the subfields of segment 3 and later segments are not lit (OFF)). In this way, the display of a certain tone is completed sequentially for each segment. Then, display of up to the next tone is performed by the next segment, and display is performed by continuous time width modulation. This feature is identical to the first embodiment.

As shown in FIG. 20, in the various segments except segment 4, during the duration of "64t", the duration of "63t" is divided into six subfields having durations of "32t", "16t", "8t", "4t", "2t" and "1t", respectively. By combining these ON/OFF subfields in the binary manner, the variation in the tone corresponding to the segment is displayed. Finally, by lighting the subfield having the duration of "1t" as the last bit, it is possible to display the brightness corresponding to the duration of "64t". In this way, for each tone "64" of segments 1 through 3, in a continuous manner, by means of a combination of ON/OFF subfields that form each segment, the variation in the tone corresponding to the segment is displayed. Among the aforementioned segments, the subfields having the duration of "1t" and lit as the last one correspond to the "adjustment subfields" of this invention, while the remaining subfields having durations of "32t", "16t", "8t", "4t", "2t" and "1t" correspond to the "binary subfields" of this invention.

As shown in FIG. 21, for display of the final tones of "193" through "255", in segment 4, the duration of "63t" is divided into five subfields having durations of "32t", "16t", "8t", "4t", "2t" and "1t", respectively, using the binary method. That is, segment 4 is made of only the subfields corresponding to the "binary subfields" of this invention.

That is, each time the tone is increased by 64, for segment 1 through segment 4, sequentially, the subfields in each segment are lit so that the tone is increased continuously. In each segment, the display is performed according to the binary method for the subfields such that the display completes within the segment.

In this embodiment, just as in the third embodiment, when the tone is increased continuously, lighting of the subfields in the segment is performed using the binary method, except for lighting of the subfields having the duration of "1t" and lit as the last one in segments 1–3. This simplifies the configuration.

In accordance with the fifth embodiment of the invention, FIG. 22 is a diagram illustrating the tone display method in this embodiment of the invention. This embodiment will not be explained specifically because the configuration of this embodiment is identical to that as shown in FIG. 1 of the first embodiment. FIG. 22 is a table illustrating which segments are lit with respect to the tone. In this embodiment, the configuration of the subfields for each segment is identical to that explained in the first embodiment. In this embodiment, for the tones of "0" through "42", the display is performed using the subfields in segment 6 (in this case, all of the subfields of the other segments are not lit), and for the tones of "43" through "86", the tone display is performed using the subfields in segment 5 (in this case, all of the subfields of segment 6 are normally lit, and all of the subfields of segments 1–4 are not lit). In this way, the time axis for the continuity of the tone between segments is opposite to that in the first embodiment.

In this way, even when the time axis for the continuity of the tone between segments is opposite, the same effect in suppressing the pseudo shadow of the moving images can be realized. This applies not only in the first embodiment, but also in the second through fourth embodiments.

In accordance with the sixth embodiment of the invention, FIG. 23 is a diagram illustrating the tone display method in this embodiment of the invention. This embodiment will not be explained specifically, because the configuration of this embodiment is identical to that as shown in FIG. 1 of the first embodiment. FIG. 23 is a table illustrating which segments are lit with respect to the tone. In this embodiment, the configuration of the subfields for each segment is identical to that explained in the first embodiment. In this embodiment, for the tones of "0" through "42", the display is performed using the subfields in segment 1 (in this case, all of the subfields of the other segments are not lit), and for the tones of "43" through "86", the tone display is performed using the subfields in segment 3 (in this case, all of the subfields of segment 1 are normally lit, and all of the subfields of the segments other than segments 1 and 3 are not lit). In this way, while the feature that the display of a certain tone is completed in each segment is identical to that in the aforementioned embodiments, there is no longer the continuity in switching the segments ON/OFF between segments. That is, as shown in FIG. 23, each time as the tone is increased by 42 (or 43), for segment 1 through segment 6, sequentially, the subfields in each segment are lit so that the tone is increased continuously. In each segment, the display is performed generally according to the binary method for the subfields such that the display is completed within the segment. Also, when the value of a segment where there is a mixture of subfields in the ON state and subfields in the OFF state is 0 before the change of display, for the segment made of plural such subfields, a change may be made from the segment made only of the subfields in the ON state to one made of only the subfields in the OFF state, and a change may be made from the segment made of only the subfields in the OFF state to one made of only the subfields in the ON state. For example, as shown in FIG. 23, in the case of a change of display from tone "170" to tone "171", one may set segment 2, which has been "all OFF", to "all ON", and set segment 6, which has been "all ON", to "all OFF". That is, the order of the ON/OFF switch of segments does not depend on the state of this embodiment, and any order may be adopted.

In this way, even when there is no longer continuity in the switching ON/OFF of segments between segments, the same effect in suppressing the pseudo shadow of the moving images can be realized. This applies not only in the first embodiment, but also in the second through fifth embodiments. As shown in the main points of segment selection in the tone display method in the first through fifth embodiments (as shown in FIG. 2, FIG. 11, FIG. 15, FIG. 19 and FIG. 22), a continuity in the switching ON/OFF of segments between segments can display the effect in suppressing the problem of spreading in moving images.

Figure 24:
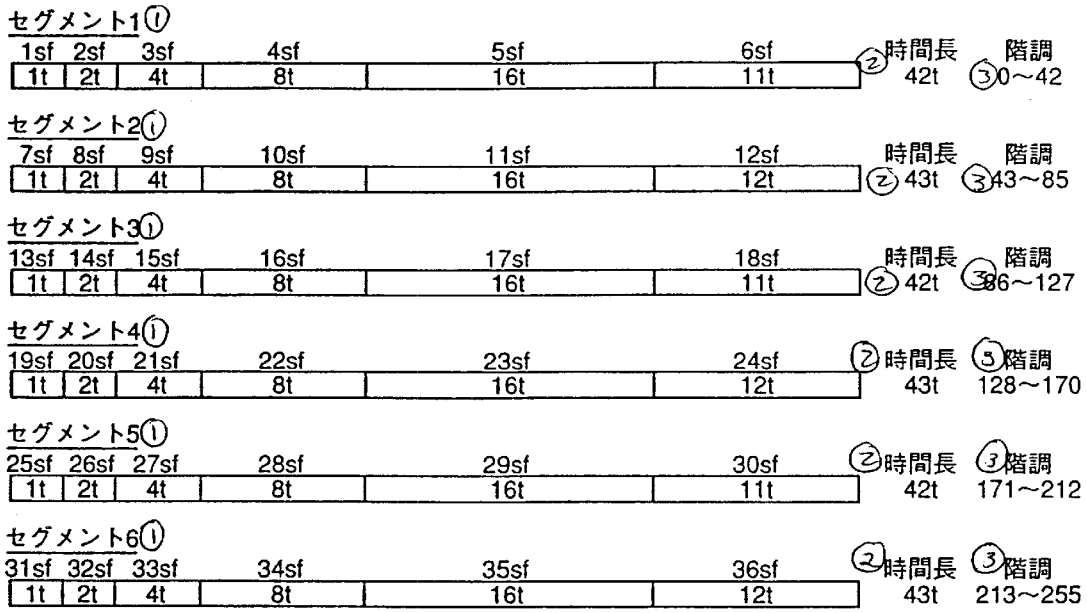
FIG. 24 is a diagram illustrating the configuration of the subfields in the tone display method in accordance with a seventh embodiment in accordance with the present invention.

In accordance with the seventh embodiment of this invention, FIGS. 24–27 are diagrams illustrating the tone display method in this embodiment of the invention. This embodiment will not be explained specifically because the configuration of this embodiment is identical to that of the first embodiment. FIG. 24 is a diagram illustrating the configuration of the subfields. FIG. 25 is a table illustrating which segments are turned ON with respect to the tone. FIGS. 26 and 27 are tables illustrating which subfields are turned ON with respect to the tone in each segment. When the box corresponding to each subfield contains characters indicating the duration of the subfield, it indicates that the subfield is lit (ON); when it is empty, it indicates that the subfield is not lit (OFF). In this embodiment, the segment number and the subfield configuration are the same as those in the first embodiment. However, the order in time of the subfields in the segment is different from that of the first embodiment.

In this embodiment, one field is displayed by 36 subfields, and an 8-bit "256" level tone is almost evenly allocated to six segments. As shown in FIG. 25, for the tones of "0" through "42", the display is performed using the subfields in segment 1 (in this case, all of the subfields of the other segments are not lit (OFF)), and for the tones of "43" through "85", the tone display is performed using the subfields in segment 2 (in this case, all of the subfields of segment 1 are normally lit (ON), and all of the subfields of segment 3 and thereafter are not lit (OFF)). In this way, the display of a certain tone is completed for each segment, and the display of the next tone is performed for the next continuous time width modulation. This feature is identical to that of the first embodiment.

In each segment, the duration of "42t" (or "43t") is divided into six subfields having durations of "lit" (or "12t"), "16t", "8t", "4t", "2t" and "1t", respectively. By means of a combination of ON/OFF subfields, the variation in the tone corresponding to the segment is displayed. This feature is identical to that in the first embodiment.

In this embodiment, however, the order in time of the subfields in one segment as counted from the subfield having a short duration is "1t"-"2t"-"4t"-"8t"-"16t"-"11t". In this way, even when the order in time in the segment is not specified, it is still possible to realize the effect of suppression of the pseudo shadow in moving images. Just as in the first embodiment of this invention, the order is as "2t"-"16t"-"4t"-"8t"-"11t"-"1t", with the subfields having durations of "2t" and "1t" as the short-time subfields are set at the beginning and end of the segment, respectively, and the subfield having duration of "4t" as the subfield having the next shortest duration is not set next to the subfields having durations of "2t" and "1t". In this way, the problem to be explained below can be avoided.

The problem pertains to load/rest of the write data of the DMD element, as presented in the reference ("10.4: Phased Reset Timing for Improved Digital Micromirror Device (DMD) Brightness," SID 98 DIGEST, pp.125–128). That is, when the load time is significantly shorter than 1t, no matter how the order in time of the subfields is selected, although there is no problem to load the data of the next subfield during the period of display of the preceding subfield, when, for example, a subfield having a duration shorter than the load time is provided, there is not sufficient time to load the data for the next subfield. This is a problem. In order to solve this problem, one may set the subfields having short duration at the head and tail of the segment. This is because, as a forced OFF time is arranged immediately before the start of the segment by means of color switch known as the spoke time, it is possible to perform load/reset of the data of the initial subfield of the segment during this period. Also, as a spoke time arrives immediately after the end of the segment, there is no need to load the data of the next subfield.

Figure 28:
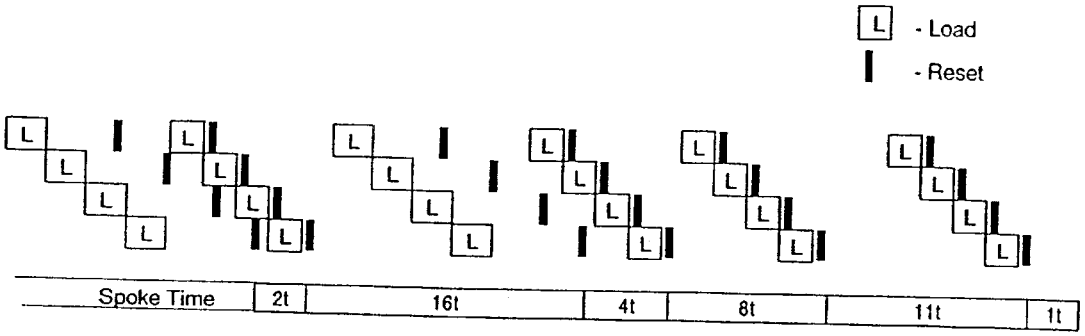
FIG. 28 is a diagram illustrating the operation of data load/reset in accordance with the first embodiment in accordance with the present invention in the tone display method.

FIG. 28 is a diagram illustrating load/reset of data when the reset group makes use of the 4-phase reset. It can be seen from this figure that in the first embodiment, even for a subfield having a duration shorter than the load time of the data, it is still possible to perform the load/reset of data properly.

In the example explained above, the subfields having durations of "4t", "2t" and "1t" are set discontinuously in time, and the subfields having durations of "2t" and "1t" are set at the two ends of each segment in time. However, generally speaking, the aforementioned problem can be solved by taking such measure for the subfields having durations shorter than twice the load time of the data of the subfield.

In the first through seventh embodiments, an explanation has been given with the example of 256 tones for red color, green color and blue color. However, this invention is not limited to this example. The tone display method of this invention can also be adopted for other colors and other tone numbers. Also, in the above explanation, for each subfield of the invention, the time is obtained by dividing the time corresponding to the prescribed color into one frame with the tone number as a unit, and having a duration corresponding to the brightness of the prescribed one color obtained when the subfield alone is ON. However, this invention is not limited to this case. Other weighting schemes may also be adopted, as long as the desired brightness can be obtained when the subfield alone is ON. In summary, the time band corresponding to one prescribed color in a frame/field comprises plural time-shared time bands. A segment in time is set corresponding to each time-shared time band. Each segment comprises one or several subfields. By assigning the subfields ON/OFF for the prescribed one color appropriately for display of the tone of the prescribed one color, the value of the segment with a mixture of the subfields in the ON state and the subfields in the OFF state is assigned 0 or 1, while the remaining segments are made with all of the subfields in the ON state or all of the subfields in the OFF state. In the case of a continuous change of tone in the display, priority goes to switching the subfields ON/OFF within the same segment; in the case of a change of display with 1-tone difference, except when the number of the segment with a mixture of the subfields in the ON state and the subfields in the OFF state is 0 before the change of display, for the segment made of plural subfields, a change is not made from the segment made of only subfields in the ON state to one made of only subfields in the OFF state, or from the segment made of only subfields in the OFF state to one made of only subfields in the ON state. In this configuration, the tone display method of this invention can be applied.

EFFECT OF THE INVENTION

As can be seen from what was explained above, this invention can provide a tone display method which can suppress a rise in cost and can prevent degradation in the image quality of moving images when the subfield method is used.

That is, in the tone display method of this invention, it is possible to prevent generation of abnormal images caused by addition of subfields with error induced by movement of the line of sight, and it is possible to improve the image quality of the moving images.

In addition, it can relax the restriction on the load time of data in a display using DMD, and it enables the setting of a time sequence for the subfields that can be carried out easily.

What is claimed is:

1. A tone display method which comprises the steps of:

providing a time band corresponding to one prescribed color within one frame/field, said time band having plural time-divided sub-time bands;

setting time segments corresponding to said time-divided sub-time bands, each of said time segments comprising a plurality of subfields;

prescribing the tone of said one color to be displayed by appropriately setting each of said plurality of subfields to one of ON or OFF;

assigning to said time segments which have a mixture of said subfields in the ON state and subfields in the OFF state the number 0 or 1 while remaining time segments contain all subfields in an ON state or all said subfields in an OFF state;

in the case of a continuous change of tone in the display, giving priority to performing the ON or OFF switch of the subfields within the same time segment;

in the case of a change of display with 1-tone difference, except when the value of the segment with a mixture of the subfields in the ON state and the subfields in the OFF state is 0 before the display change, for the segment made of plural said subfields, not making a change from the segment containing only the said subfields in the ON state to that containing only said subfields in the OFF state and from said segment containing only said subfields in the OFF state to that containing only said subfields in the ON state.

2. The tone display method described in claim 1 wherein, in the case of a continuous change of tone in the display, selecting said segment according to the order in time of the segments for changing of the ON/OFF state of the subfields.

3. The tone display method described in claim 1 wherein:

for each said subfield, the value obtained by dividing the brightness obtained when all of the subfields corresponding to said prescribed one color are ON with the tone number is defined as a unit, and the subfield has a weight corresponding to the brightness of said prescribed one color obtained when only the subfield in ON; all or a portion of said plural subfields of each said segment is n+1 said subfields, n being a prescribed natural number; each of the subfields being a binary subfield having a weight $2^0$, $2^1$, . . . $2^n$ times said one unit; when a continuous change of tone in the display is performed, carrying out the ON/OFF switch of various said binary subfields in an order of priority corresponding to $2^0$, $2^1$, . . . $2^n$.

4. The tone display method described in claim 2 wherein:

for each said subfield, the value obtained by dividing the brightness obtained when all of the subfields corresponding to said prescribed one color are ON with the tone number is defined as a unit, and the subfield has a weight corresponding to the brightness of said prescribed one color obtained when only the subfield in ON; all or a portion of said plural subfields of each said segment is n+1 said subfields, n being a prescribed natural number; each of the subfields being a binary subfield having a weight $2^0$, $2^1$, . . . $2^n$ times said one unit; when a continuous change of tone in the display is performed, carrying out the ON/OFF switch of various said binary subfields in an order of priority corresponding to $2^0$, $2^1$, . . . $2^n$.

5. The tone display method according to claim 3 wherein a portion of said plural subfields of each said segment is the adjustment subfield, which is a subfield other than a binary subfield; when a continuous change of tone in the display is carried out, carrying out the changing of ON/OFF states between said binary subfields with priority in the changing of ON/OFF states of said adjustment subfield.

6. The tone display method according to claim 4 wherein a portion of said plural subfields of each said segment is the adjustment subfield, which is a subfield other than a binary subfield; when a continuous change of tone in the display is carried out, carrying out the changing of ON/OFF states between said binary subfields with priority in the changing of ON/OFF states of said adjustment subfield.

7. The tone display method according to claim 5 further including providing each said segment with only one said adjustment subfield; said only one adjustment subfield having a weight identical to said one unit.

8. The tone display method according to claim 6 further including providing each said segment with only one said adjustment subfield; said only one adjustment subfield having a weight identical to said one unit.

9. The tone display method according to claim 3 wherein said weight is a duration which takes the time obtained by dividing the time corresponding to said one color in said one frame/field with the tone number as a unit.

10. The tone display method according to claim 8 wherein said weight is a duration which takes the time obtained by dividing the time corresponding to said one color in said one frame/field with the tone number as a unit.

11. The tone display method according to claim 9 wherein, when said subfield which has said duration shorter than the load time of data of each said subfield is present, for each said segment, not setting continuously in time said subfields having said duration shorter than twice said load time.

12. The tone display method according to claim 10 wherein, when said subfield which has said duration shorter than the load time of data of each said subfield is present, for each said segment, not setting continuously in time said subfields having said duration shorter than twice said load time.

13. The tone display method according to claim 9 wherein, when said subfield which has said duration shorter than the load time of data of each said subfield is present, for each said segment, setting a subfield having a duration shorter than twice said load time at the beginning and/or at the end in time.

14. The tone display method according to claim 10 wherein, when said subfield which has said duration shorter than the load time of data of each said subfield is present, for each said segment, setting a subfield having a duration shorter than twice said load time at the beginning and/or at the end in time.

15. The tone display method according to claim 11 wherein, when said subfield which has said duration shorter than the load time of data of each said subfield is present, for each said segment, setting a subfield having a duration shorter than twice said load time at the beginning and/or at the end in time.

16. The tone display method according to claim 12 wherein, when said subfield which has said duration shorter than the load time of data of each said subfield is present, for each said segment, setting a subfield having a duration shorter than twice said load time at the beginning and/or at the end in time.

* * * * *